US010827855B2

(12) United States Patent
Charlier et al.

(10) Patent No.: US 10,827,855 B2
(45) **Date of Patent: *Nov. 10, 2020**

(54) ADJUSTABLE BREATH GUARD

(71) Applicant: The Vollrath Company, L.L.C., Sheboygan, WI (US)

(72) Inventors: David Charlier, Sheboygan, WI (US); Robert Hebel, New London, WI (US); Jill Hundley, Sheboygan, WI (US); Andrew Laures, Cleveland, WI (US)

(73) Assignee: The Vollrath Company, L.L.C ., Sheboygan, WI (US)

( * ) Notice: Subject to any disclaimer, the term of this patent is extended or adjusted under 35 U.S.C. 154(b) by 92 days.

This patent is subject to a terminal disclaimer.

(21) Appl. No.: 16/161,521

(22) Filed: Oct. 16, 2018

(65) Prior Publication Data

US 2019/0110614 A1 Apr. 18, 2019

Related U.S. Application Data

(60) Provisional application No. 62/573,011, filed on Oct. 16, 2017.

(51) Int. Cl.

| | |
|---|---|
| ***A47F 10/06*** | (2006.01) |
| ***A47F 3/00*** | (2006.01) |
| *A47F 3/12* | (2006.01) |

(52) U.S. Cl.

CPC ..... *A47F 10/06* (2013.01); *A47F 3/007* (2013.01); *A47F 3/004* (2013.01); *A47F 3/12* (2013.01);

(Continued)

(58) Field of Classification Search

CPC .. A47F 10/06; A47F 3/007; A47F 3/12; A47F 3/004; A47F 2003/008; A47F 2010/065; A47B 9/00; A47B 96/18

(Continued)

(56) References Cited

U.S. PATENT DOCUMENTS 443,350 A * 12/1890 Barners
1,023,789 A * 4/1912 Miller ..... A47F 3/004 312/130

(Continued)

FOREIGN PATENT DOCUMENTS

DE 10320528 A1 12/2004
JP 2007-159882 A 6/2007

OTHER PUBLICATIONS

BSI: DECO Engineered Food Shields, Model: DECO-250-N, Apr. 30, 2017 (Apr. 30, 2017), XP055544067, Retrieved from the Internet: URL:https://assetcloud.roccommerce.net//files/_singer/4/10/8/10004447_spec_sheet.pdf.

(Continued)

*Primary Examiner* — Janet M Wilkens
(74) *Attorney, Agent, or Firm* — Foley & Lardner LLP

(57) ABSTRACT

A breath guard for a food serving system includes first and second supports positioned laterally offset from one another, a guide rail coupled to the first support and extending in a substantially longitudinal direction, an adjustable panel extending between the first and second supports, and an adjustment mechanism coupled to the adjustable panel and configured to selectively engage the guide rail in a series of locations. The adjustable panel is rotatably and translatably coupled to the guide rail and is rotatable relative to the guide rail about an axis of rotation that extends laterally. The adjustment mechanism prevents longitudinal movement of the adjustable panel in a first direction and allows movement in a second direction opposite the first direction when the adjustment mechanism engages the guide rail, such that the adjustable panel is selectively repositionable between a plurality of longitudinal positions.

20 Claims, 29 Drawing Sheets

(52) U.S. Cl.
CPC ... *A47F 2003/008* (2013.01); *A47F 2010/065* (2013.01)

(58) Field of Classification Search
USPC ..... 312/137, 114, 139.1, 140, 140.4, 323, 312/322
See application file for complete search history.

(56) References Cited

U.S. PATENT DOCUMENTS 1,075,334 A * 10/1913 Cobb ..... A47F 3/12 312/137
1,288,665 A * 12/1918 Page ..... E05D 15/582 312/110
1,431,371 A * 10/1922 Chapman ..... A47F 3/12 312/114
1,644,675 A * 10/1927 Huening ..... A47F 3/12 312/114
1,725,867 A 8/1929 Kennedy
3,554,416 A 1/1971 Bott
4,448,337 A 5/1984 Cronce
4,469,261 A 9/1984 Stapleton et al.
4,500,020 A 2/1985 Rasor
4,660,885 A 4/1987 Suhr et al.
6,132,018 A 10/2000 McGrath
6,390,424 B1 5/2002 Kidushim et al.
6,485,118 B2 11/2002 Matus, Jr.
D472,083 S 3/2003 English et al.
6,588,863 B1 7/2003 Yatchak et al.
D497,739 S 11/2004 English et al.
7,040,723 B2 5/2006 Matus, Jr.
7,210,742 B2 5/2007 Wu
D575,560 S 8/2008 English
7,640,696 B2 1/2010 Yingst
7,958,673 B2 6/2011 Yingst et al.
D649,865 S 12/2011 English et al.
8,109,579 B2 2/2012 English et al.
8,128,306 B2 3/2012 Gorza
8,302,919 B1 11/2012 McGrath
8,308,249 B2 11/2012 Matus, Jr.
8,403,430 B2 3/2013 Atkins
8,585,160 B2 11/2013 Atkins
8,671,618 B2 3/2014 Yingst et al.
8,925,172 B2 1/2015 English
8,973,876 B1 3/2015 McGrath
9,010,883 B2 4/2015 Scott
9,062,483 B1 6/2015 McGrath
9,291,188 B2 3/2016 English
D756,759 S 5/2016 Atkins et al.
9,326,621 B1 5/2016 McAllister et al.
9,339,131 B1 5/2016 Christianson
9,557,004 B1 * 1/2017 McGrath ..... F16M 13/02
10,415,285 B1 * 9/2019 Anderson ..... E05D 11/08
2003/0057810 A1 3/2003 Dewitt
2004/0226903 A1 11/2004 Wang
2006/0163976 A1 7/2006 Matus, Jr.
2006/0175940 A1 8/2006 English
2006/0192467 A1 8/2006 Matus, Jr.
2007/0236112 A1 10/2007 Williman
2011/0080075 A1 4/2011 Matus, Jr.
2011/0169384 A1 7/2011 Padden et al.
2014/0366751 A1 12/2014 Atkins et al.
2015/0289641 A1 * 10/2015 Ergun ..... A47B 13/003 108/42
2016/0073795 A1 3/2016 Matus, Jr.
2018/0242760 A1 * 8/2018 Cummings ..... A47F 3/007
2019/0110588 A1 * 4/2019 Wong ..... A47B 9/16
2019/0110613 A1 * 4/2019 Charlier ..... A47F 10/06
2019/0110614 A1 4/2019 Charlier et al.
2019/0128034 A1 * 5/2019 Luedtke ..... E05D 15/583
2019/0350386 A1 * 11/2019 Cummings ..... A47F 10/06
2020/0046146 A1 * 2/2020 Hansen ..... A47F 10/06

OTHER PUBLICATIONS

International Search Report and Written Opinion of the International Searching Authority for PCT/US2018/000384 dated Jan. 28, 2019.

* cited by examiner

ADJUSTABLE BREATH GUARD

CROSS-REFERENCE TO RELATED PATENT APPLICATIONS

This application claims the benefit of U.S. Provisional Patent Application No. 62/573,011, filed Oct. 16, 2017, which is incorporated herein by reference in its entirety.

BACKGROUND

The present invention relates generally to the field of food serving systems and, in particular, to the field of breath guards for food serving systems.

Conventional food serving systems include a base that houses a number of pans or other containers configured to hold prepared food exposed to facilitate serving to a customer. The base may include heating and/or refrigeration components configured to keep the food at a desired serving temperature while the food is served to a customer. To protect the exposed food, the food serving systems conventionally include a breath or sneeze guard coupled to the top of the base. Breath guards conventionally include one or more transparent panels that extend between a customer and the food. The breath guard provides a barrier between the customer and the prepared food in order to prevent potential contamination and maintain a healthy environment for both customers and foodservice staff.

Breath guards for food serving systems are configured differently depending upon the situation in which they are used. In a buffet setting, customers access food displayed in the food serving system from one or both of a front side and a back side of the food serving system. Accordingly, breath guards used in such situations leave at least one side facing the customer uncovered to facilitate access to the food. In a cafeteria setting, food service staff stand on one side of the food serving system and serve food to a customer located on the other side. In such a situation, the customer does not require access to the food serving system. Accordingly, breath guards used in such a situation block a front side that faces the customer to protect the food. Some conventional breath guards provide a single fixed configuration that is useful in either a buffet setting or a cafeteria setting. Such breath guards limit the food serving system from being used in multiple types of situations. Other types of conventional breath guards are adjustable. However, adjustment of such breath guards typically requires more than one operator, especially when the breath guard is configured to cover a large area. Accordingly, there is a need for a breath guard that can be easily reconfigured for use in both a buffet setting and a cafeteria setting by a single operator.

SUMMARY

At least one embodiment relates to a breath guard for a food serving system. The breath guard includes a first support and a second support positioned laterally offset from one another, a guide rail coupled to the first support and extending in a substantially longitudinal direction, an adjustable panel extending between the first support and the second support, and an adjustment mechanism coupled to the adjustable panel and configured to selectively engage the guide rail in a series of locations. The adjustable panel is rotatably and translatably coupled to the guide rail. The adjustable panel is rotatable relative to the guide rail about an axis of rotation that extends laterally. The adjustment mechanism is configured to prevent longitudinal movement of the adjustable panel relative to the guide rail in a first direction and allow longitudinal movement of the adjustable panel in a second direction opposite the first direction when the adjustment mechanism engages the guide rail, such that the adjustable panel is selectively repositionable between a series of longitudinal positions relative to the guide rail.

Another embodiment relates to a breath guard for a food serving system. The breath guard includes a first support and a second support positioned laterally offset from one another, a first guide rail coupled to the first support and extending in a substantially longitudinal direction, a second guide rail coupled to the second support and extending substantially parallel to the first guide rail, an adjustable panel extending between the first support and the second support, an adjustment mechanism coupled to the adjustable panel and configured to selectively engage the first guide rail, a first wrist system including a first mounting plate and a first wrist body rotatably coupled to the first mounting plate, and a second wrist system including a second mounting plate and a second wrist body rotatably coupled to the second mounting plate. The adjustable panel is rotatably and translatably coupled to the first guide rail and the second guide rail. The adjustable panel is rotatable relative to the first guide rail and the second guide rail about an axis of rotation that extends laterally. The first mounting plate is coupled to the first support. The first wrist body includes a first slot that receives the adjustable panel and is configured to allow the adjustable panel to slide within the first slot. The second mounting plate is coupled to the second support. The second wrist body includes a second slot that receives the adjustable panel and is configured to allow the adjustable panel to slide within the second slot. The adjustment mechanism is configured to prevent longitudinal movement of the adjustable panel relative to the first guide rail in a first direction and allow longitudinal movement of the adjustable panel in a second direction opposite the first direction when the adjustment mechanism engages the first guide rail.

BRIEF DESCRIPTION OF THE DRAWINGS

The invention will become more fully understood from the following detailed description, taken in conjunction with the accompanying drawings, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to the Figures, a breath guard for a food serving system is shown according to various exemplary embodiments. In some embodiments, the breath guard includes a pair of frame assemblies laterally offset from one another and an adjustable panel extending between the frame assemblies. Near the top of each frame assembly is a guide rail system. A carriage system within each guide rail system receives a hanger pin from each end of the adjustable panel. Each carriage system is coupled to a guide rail such that the carriage systems constrain the movement of an axis of rotation of the adjustable panel to purely longitudinal directions. Each carriage system includes a pawl that is configured to engage corresponding pawl apertures defined by the guide rail to selectively prevent movement of the carriage in a first longitudinal direction, holding the adjustable panel in a buffet configuration. The carriages are configured to move freely in a second longitudinal direction. The carriage systems each also include a plunger that is biased outward by a spring. Near an end of the guide rail, the plunger is configured to engage a motion control device having a series of sloped surfaces. The sloped surfaces force the plunger into the carriage to dissipate momentum of the adjustable panel. A detent between the sloped surfaces biases holds the plunger in a position that corresponds to a cafeteria configuration of the adjustable panel. The adjustable panel is received by a pair of wrist systems which are in turn coupled to the frame assemblies. The wrist systems permit the adjustable panel to slide therethrough along a slide-through axis, but limit movement of the adjustable panel perpendicular to the slide-through axis. Accordingly, the wrist systems constrain the adjustable panel to a different orientation for every longitudinal position of the adjustable panel.

Figure 1:
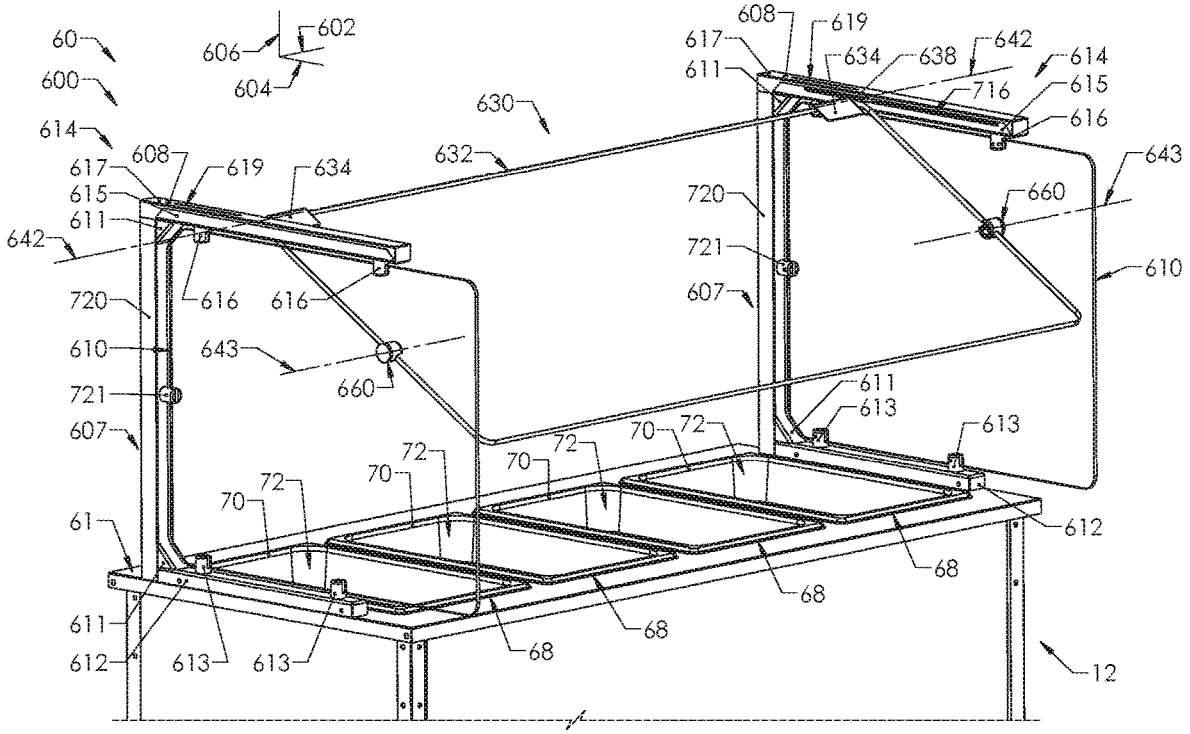
FIG. 1 is a perspective view of a food display system including a breath guard, according to an exemplary embodiment.

Referring to FIG. 1, a food serving system or food display system is shown as system 60 according to an exemplary embodiment. The system 60 includes a cabinet, fixture, or chassis, shown as base 12, configured to support a series of pans or other containers, shown as food pans 70. The food pans 70 rest upon a top surface 61 of the base 12. In some embodiments, the top surface 61 of the base 12 is located at approximately waist height. The base 12 defines one or more wells or apertures in the top surface 61 configured to receive the food pans 70. The food pans 70 each include a lip 68 that is configured to rest upon the top surface 61. In other embodiments, the base 12 includes another type of food preparation or display surface, such as a counter or carving station.

Each of the food pans 70 are configured to receive prepared food (e.g., meats, ice cream, pasta, vegetables, etc.) within a depression 72. The size and shape of each depression 72 may be varied depending on the type of food that is received by the depression 72. The food may be kept at a warm temperature (e.g., cooked meats), a cold temperature (e.g., raw meats, ice cream, cheeses, etc.), or at room temperature (e.g., apples, bananas, bread, etc.) while serving. Accordingly, the base 12 may include a heating mechanism (e.g., a resistance heater, a gas burner, etc.) and/or a cooling mechanism (e.g., a refrigeration circuit, etc.) to keep the food pans 70 at a desired temperature. In some embodiments, the base 12 includes a temperature sensor (e.g., configured to measure the temperature of one or more of the food pans 70) to facilitate closed-loop temperature control. The base 12 may control the temperatures of the food pans 70 directly, or the base 12 may control the temperature of another medium (e.g., water) that contacts the food pans 70 to regulate the temperature of the food pans 70. In other embodiments, one or more of the food pans 70 are removed and the base 12 provides a flat or raised surface on which to prepare food (e.g., a cutting board) and/or display food (e.g. a serving tray).

Referring again to FIG. 1, the system 60 includes an adjustable sneeze guard assembly, breath guard assembly, or food shield assembly, shown as breath guard 600. The breath guard 600 is coupled to the top surface 61 and extends upward from the top surface 61. Alternatively, the breath guard 600 may extend through or extend around the top surface 61 to couple to another portion of the base 12. The breath guard 600 is configured to act as a barrier between one or more users and the food pans 70, protecting the food held in the food pans 70 from contamination (e.g., from sneezing, from coughing, from breathing, from touching, etc.). The breath guard 600 is configured such that the area covered by the breath guard 600 is adjustable for use in multiple different situations. By way of example, breath guard 600 may be reconfigurable between a first configuration where the breath guard 600 blocks access to the food pans 70 from a front side of the system 60 and a second configuration where the breath guard 600 permits access from the front side, but blocks a portion of the front side to provide a shield between a customer and the food.

Referring again to FIG. 1, the breath guard 600 extends along a lateral axis 602, a longitudinal axis 604, and a vertical axis 606. The breath guard 600 includes a pair of supports or dividers, shown as side panels 610, each configured to be coupled to the top surface 61 by a frame assembly, shown as side frame assembly 607. The side frame assemblies 607 each include a support or foot, shown as bracket 612, which extends between the side panel 610 and the top surface 61, coupling the side panel 610 to the base 12. The side panels 610 are spaced apart from one another laterally and extend vertically upward from the top surface 61. As shown in FIG. 1, the side panels 610 have a sufficient width to prevent access to the food pans 70 from the lateral sides of the base 12 (e.g., from a customer attempting to access the food pans 70 along the lateral axis 602). In an alternative embodiment, the side panels 610 are significantly narrower than the lateral sides of the base 12 such that access to the food pans 70 from the lateral sides of the base 12 is minimally obstructed.

The side frame assemblies 607 each include one or more couplers, clamps, brackets, or clips, shown as panel clips 613, that are coupled to each bracket 612. The panel clips 613 each define a groove that is configured to receive a bottom end portion of the corresponding side panel 610. The panel clips 613 are coupled to the side panels 610, coupling the side panels 610 to the bracket 612. By way of example, each panel clip 613 may include a set screw that presses against the side panel 610 to hold the side panel 610 in place. By way of another example, each panel clip 613 may include a pin (e.g., a fastener) that extends through a corresponding aperture in the side panel 610 to hold the side panel 610 in place. A top end portion of each side panel 610 is coupled to a component or assembly of the side frame assembly 607, shown as guide rail system 614. The guide rail systems 614 each extend substantially parallel to the longitudinal axis 604 along a top surface of each side panel 610. Each guide rail system 614 includes a base member, frame rail, or track, shown as frame rail 615. A pair of couplers, clamps, brackets, or clips, shown as panel clips 616, are coupled to the frame rail 615. The panel clips 616 may be substantially similar to the panel clips 613, except the panel clips 616 receive the top end portions of the side panels 610. Each guide rail system 614 further includes a cover, shown as frame rail cover 617, which is removably coupled to the frame rail 615. The frame rail cover 617 obscures one or more components coupled to the frame rail 615.

Each side frame assembly 607 includes a support or frame member, shown as spine 720, that extends vertically between the guide rail system 614 and the corresponding bracket 612. The spines 720 are coupled (e.g., fastened, welded, etc.) to the respective bracket 612 and frame rail 615 such that the spines 720 support the guide rail systems 614 and any components coupled to the guide rail systems 614. A pair of support members or brackets, shown as frame gussets 611, are positioned adjacent the intersections of the spine 720 with the bracket 612 and the frame rail 615. The frame gussets 611 increase the strength of the connections between the spine 720, the bracket 612, and the frame rail 615. The frame gussets 611 may additionally obscure one or more fasteners and/or apertures. On each side of the breath guard 600, one of the frame gussets 611 extends between and couples the spine 720 and the bracket 612, and another of the frame gussets 611 extends between and couples the spine 720 and the frame rail 615. The bracket 612, the frame rail 615, the spine 720, and the frame gussets 611 may be coupled using any coupling technique (e.g., fastening, interlocking features, welding, etc.).

Figure 11:
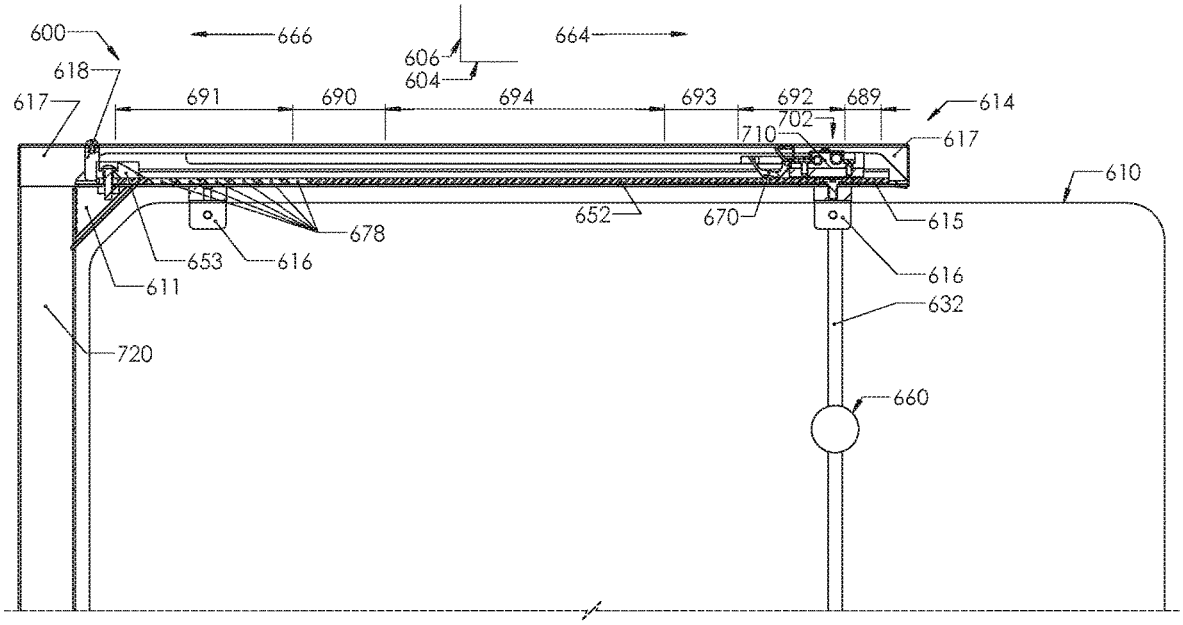
FIG. 11 is a side section view of the breath guard of FIG. 1.
Figure 14:
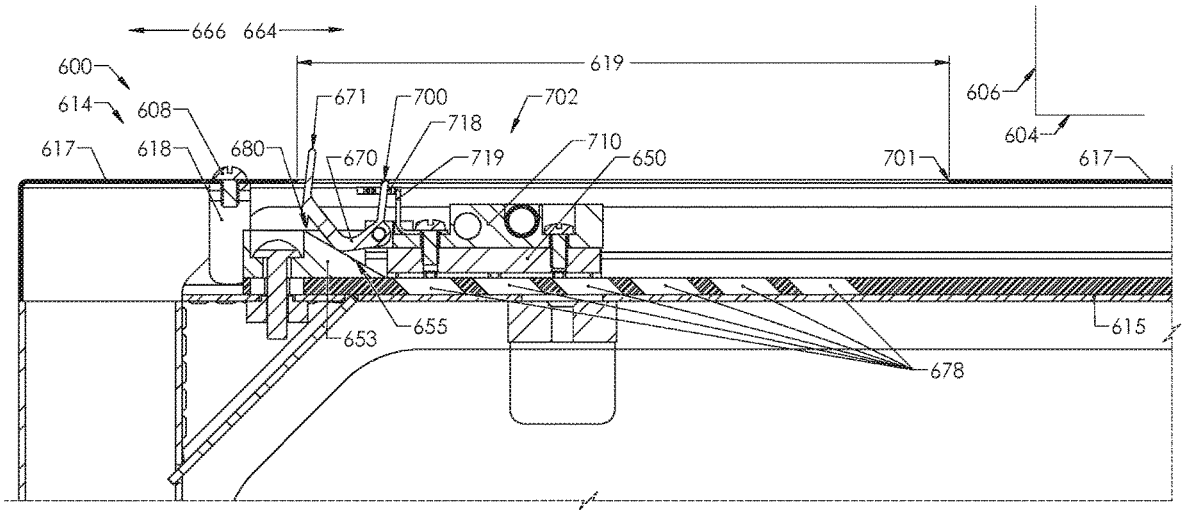
Figure 15:
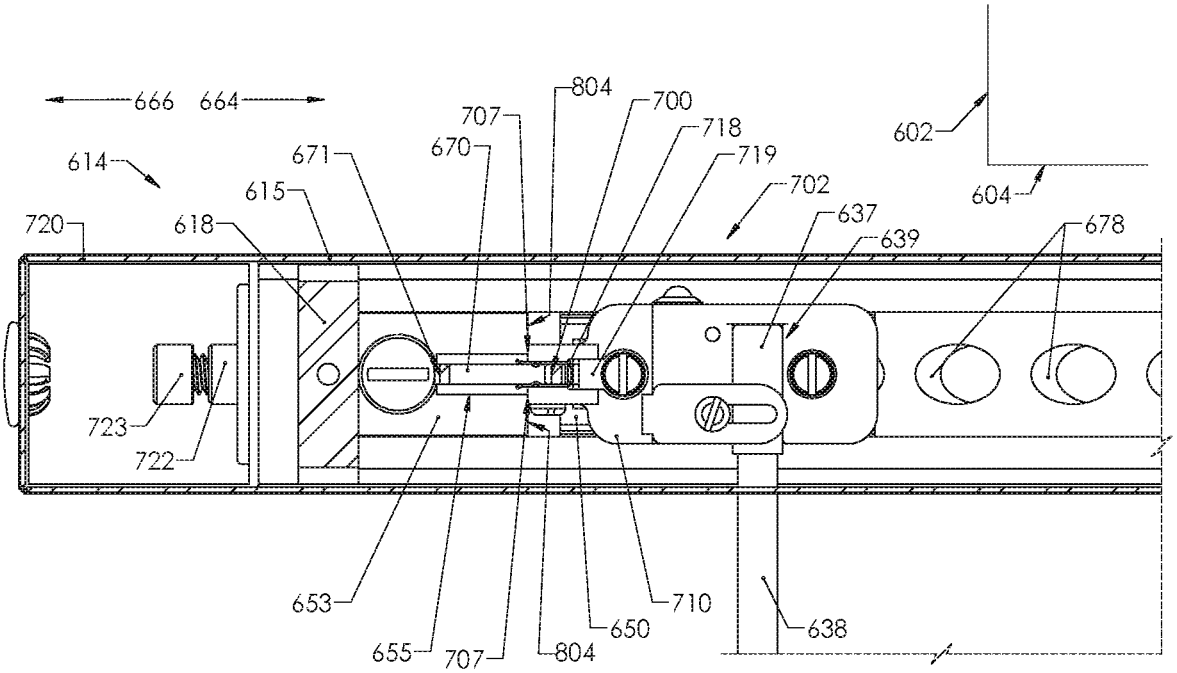
FIG. 15 is a top section view of the guide rail system of FIG. 1.

As shown in FIGS. 11, 14, and 15, the spines 720 are hollow tubular members, facilitating the passage of hoses and/or wires therethrough to power one or more accessories without the hoses or wires being visible. By way of example, a user may attach a light bar to the side frame assemblies 607 such that the light bar illuminates food supported by the base 12. By way of another example, a user may attach a resistive heating element (e.g., a heat strip) to the side frame assemblies 607 such that the heat strip radiates heat that warms food supported by the base 12. Wires that power the accessory may extend from the base 12, through the top surface 61, through the spine 720, and out through an aperture defined in the guide rail system 614 or the spine 720 to meet the accessory. Such a wire would be minimally exposed, facilitating cleanliness and a more organized overall appearance. The accessory may be supported by a bracket, coupler, or attachment that is coupled to the spine 720 or to the frame rail cover 617.

As shown in FIG. 1, a coupler, clamp, bracket, or clip, shown as panel clip 721, is coupled to the spine 720. The panel clips 721 may be substantially similar to the panel clips 613, except the panel clips 721 receive the rear end portions of the side panels 610. To couple the side panels 610 to the side frame assemblies 607, the panel clips 613, 616, and 721 may be rotated such that the grooves that receive the side panels 610 are oriented substantially perpendicular to the lateral axis 602. The side panels 610 may then be inserted into the grooves, and the panel clips 613, 616, and 721 may be coupled to the side panels 610 (e.g., using fasteners, etc.). The grooves of the panel clips 613, 616, and 721 may be wide enough to provide easy alignment and insertion of the side panels 610. The side panel 610 can then be easily removed (e.g., for cleaning, for replacement, etc.) by loosening the fasteners of the panel clips 613, 616, and 721. The panel clips 613, 616, and 721 transmit loads between the side panels 610 and the side frame assemblies 607, strengthening the breath guard 600. By way of example, the addition of the side panels 610 may increase the vertical strength of the side frame assemblies 607.

Referring to FIGS. 1-4, the breath guard 600 further includes a front panel system or adjustable panel assembly, shown as adjustable panel 630. The adjustable panel 630 is configured to selectively prevent customers from accessing the food within the food pans 70. The adjustable panel 630 includes a front shield or panel 632 and a pair of front panel hangers, shown as brackets 634. As shown, the brackets 634 are spaced laterally apart from one another such that the brackets 634 are positioned at opposite lateral ends of the panel 632. The brackets 634 are each coupled (e.g., adhered, fastened) to the top end of the panel 632 by a coupler, shown in FIG. 4 as panel attachment feature 636. In one embodiment, the panel attachment feature 636 is a slot that receives the panel 632. The panel attachment feature 636 may include adhesive or a fastener that facilitates the coupling. The adjustable panel 630 extends between the side panels 610, from the guide rail system 614 on one of the side panels 610 to the guide rail system 614 on the other of the side panels 610. A support member (e.g., a pin, a rod, etc.), shown as hanger pin 638, is coupled to each bracket 634. Each hanger pin 638 extends laterally outward from the corresponding bracket 634 and is received by a laterally extending slot, shown as pin slot 716, defined between the frame rail 615 and the frame rail cover 617. In other embodiments, a single bracket 634 couples both of the hanger pins 638 to the panel 632. The hanger pins 638 rotatably and translatably couple the adjustable panel 630 to the guide rail systems 614. Specifically, the adjustable panel 630 is configured to rotate about a laterally extending axis, shown as axis of rotation 642, which extends through the centers of the hanger pins 638. In some embodiments, the guide rail systems 614 and the hanger pins 638 limit or prevent vertical movement of the axis of rotation 642. The adjustable panel 630 is accordingly configured to translate longitudinally.

Figure 2:
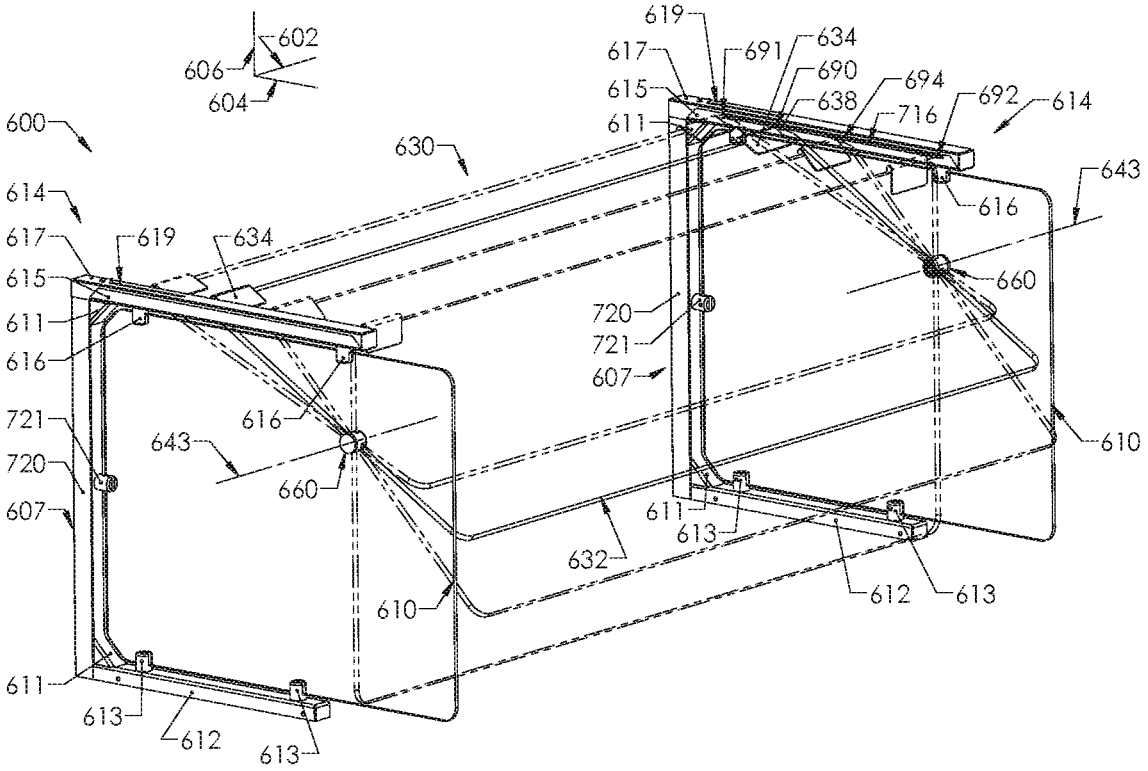
FIG. 2 is a perspective view of the breath guard of FIG. 1.

Referring to FIGS. 1 and 2, the breath guard 600 includes a pair of holding or rotational positioning mechanisms, shown as wrist systems 660. The wrist systems 660 are configured to support the adjustable panel 630 and constrain the rotational movement of the adjustable panel 630 such that each longitudinal position of the adjustable panel 630 has a corresponding rotational position (i.e., orientation). FIGS. 1-4 illustrate this constrained movement. The wrist systems 660 partially surround the adjustable panel 630, preventing the adjustable panel 630 from being lifted off of or falling down from the wrist systems 660. In some embodiments, the breath guard 600 includes only one wrist system 660.

Figure 5:
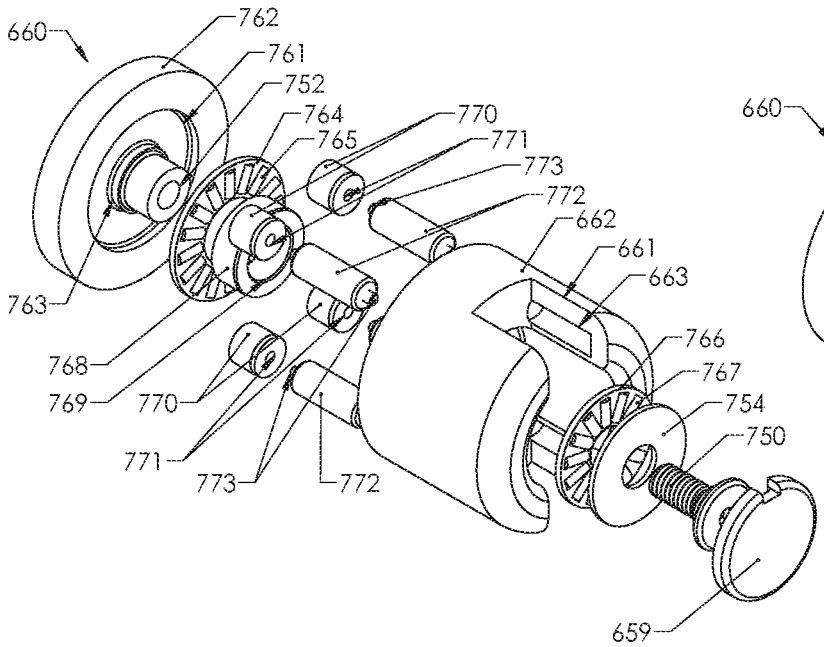
FIG. 5 is an exploded perspective view of a wrist system of the breath guard of FIG. 1.
Figure 6:
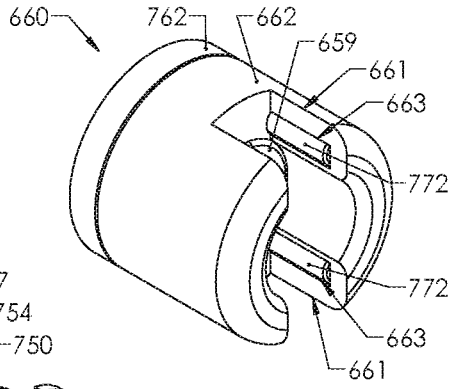
FIG. 6 is a perspective view of the wrist system of FIG. 5.

Referring to FIGS. 5 and 6, each wrist system 660 includes a base member, shown as mounting plate 762, fixedly coupled to one of the side panels 610. To prevent the mounting plate 762 from rotating relative to the side panel 610, the mounting plate 762 may include one or more projections (e.g., bosses, keys, etc.) that extend from the mounting plate 762 to engage a corresponding aperture or recess defined in the side panel 610. Alternatively, the mounting plate 762 may be coupled to the side panel 610 using an adhesive (e.g., cyanoacrylate, etc.). The wrist system 660 further includes a holding member, shown as wrist body 662, rotatably coupled to the mounting plate 762.

A fastener 750 extends through an aperture defined by the wrist body 662 and engages a corresponding threaded aperture 752 defined in the center of the mounting plate 762, rotatably coupling the wrist body 662 and the mounting plate 762. A washer 754 positioned on the shaft of the fastener 750 distributes torsional and compressive loads imparted on the wrist body 662 over the head of the fastener 750. The fastener 750 can be used to couple the wrist body 662 to the mounting plate 762 after the mounting plate 762 has been coupled to the side panel 610. This facilitates precise placement of the mounting plate 762 without having to work around the wrist body 662.

The mounting plate 762 defines an annular groove or slot, shown as indent 761, centered about the threaded aperture 752. The mounting plate 762 further includes a protrusion or projection, shown as boss 763, which increases the thickness of the mounting plate 762 at the threaded aperture 752, increasing the amount of engagement between the fastener 750 and the mounting plate 762. A first bushing or bearing, shown as thrust bearing 764, is received within the indent 761. The thrust bearing 764 includes a series of rollers 765 that extend between and engage the mounting plate 762 and the wrist body 662, reducing friction caused by a compressive lateral loading imparted on the wrist system 660 (e.g., by imparting a torsional loading on the wrist system 660). A second bushing or bearing, shown as thrust bearing 766, is received between the wrist body 662 and the washer 754, which is held in place by a head of the fastener 750. The thrust bearing 766 includes a series of rollers 767 that extend between and engage the wrist body 662 and the washer 754, reducing friction caused by a tensile lateral loading imparted on the wrist system 660 (e.g., by imparting a torsional loading on the wrist system 660). A third bushing or bearing, shown as bushing 768, defines an aperture 769 that receives the outer diameter of the boss 763. The bushing 768 extends between and engages the outer diameter of the boss 763 and the wrist body 662, reducing friction caused by longitudinal and/or vertical loading on the wrist system 660. Together the thrust bearing 764, the thrust bearing 766, and the bushing 768 reduce friction within the wrist system 660 while precisely controlling the rotational movement of the wrist body 662. The space between the wrist body 662 and the mounting plate 762 is minimized such that, in the event of an impact to the wrist body 662, the force is transferred from the wrist body 662 to the mounting plate 762 with minimal damage while preserving intact the function of the friction-reducing components and their ability to provide space between the wrist body 662 and the mounting plate 762.

The wrist body 662 defines a pair of grooves or slots, shown as slots 661. The slots 661 are aligned with one another. The slots 661 extend through the entire width of the wrist body 662 and laterally inward away from the mounting plate 762. The slots 661 are configured to receive the panel 632 of the adjustable panel 630 such that the wrist body 662 at least partially surrounds the panel 632. The wrist body 662 defines a series of apertures or recesses, shown as axle recesses 663. Specifically, the wrist body 662 defines four axle recesses 663, one on each side of each slot 661. The axle recesses 663 each define an opening that opens into the slot 661 and an opening that opens laterally outward toward the mounting plate 762. The axle recesses 663 are each configured to receive a cylindrical roller or pin, shown as roller 772. The rollers 772 are each positioned tangent to the panel 632 and configured to rotate about their own central lateral axis. Each roller 772 includes a pair of projections, protrusions, or pins, shown as axles 773, extending laterally from each side of the roller 772. One of the axles 773 engages the wrist body 662, rotationally coupling the roller 772 to the wrist body 662. The other axle 773 is received within a cylindrical spacer, shown as wrist spacer 770. Specifically, the axle 773 is received within an aperture 771 of the wrist spacer 770, rotatably coupling the roller 772 and the wrist spacer 770. The wrist spacer 770 is configured to engage the wall of the axle recess 663, limiting vertical movement of the roller 772 and longitudinal movement of the roller 772 in a first direction relative to the wrist body 662. The wrist spacer 770 is press fit into the axle recess 663, limiting longitudinal movement of the roller 772 in a second direction opposite the first direction. The wrist spacer 770 may be positioned such that the wrist spacers 770 do not engage the mounting plate 762 unless an abnormally large load is experienced by the wrist system 660. Alternatively, the wrist spacer 770 may be configured to engage the mounting plate 762 to limit longitudinal movement of the roller 772. The axle recess 663 may be sized to be a close fit with the corresponding axle 773 such that, in the event of an impact to the axle 773, the force is absorbed by the wrist body 662 with minimal damage.

A plate or cover, shown as low-friction cover 659, is coupled to the wrist body 662. The low-friction cover 659 faces laterally inward and covers the fastener 750. The low-friction cover 659 is made from a material that has a low coefficient of friction when engaging the material of the panel 632 (e.g., plastic and glass, respectively).

Referring to FIGS. 1 and 2, together, the rollers 772 and the low-friction covers 659 constrain the movement of the adjustable panel 630 such that the adjustable panel 630 is forced to rotate about a lateral axis, shown as axis of rotation 643, extending through the centers of the wrist systems 660. The rollers 772 of each wrist system 660 engage the panel 632 at four different points, limiting or preventing relative rotation between the wrist body 662 and the adjustable panel 630 about the axis of rotation 643. The wrist bodies 662 and the adjustable panel 630 are free to rotate together about the axis of rotation 643, which is fixed relative to the side panels 610 by the mounting plates 762. The low-friction covers 659 each engage the lateral sides of the panel 632, limiting outward lateral movement of adjustable panel 630. The rollers 772 and the low-friction covers 659 minimize friction between the adjustable panel 630 and the wrist systems 660, facilitating free movement of the adjustable panel 630 through the slots 661. As shown in FIG. 1, the wrist systems 660 are positioned on opposing lateral sides of the adjustable panel 630. Accordingly, the adjustable panel 630 can slide through the slots 661, but the adjustable panel 630 is prevented from leaving the slots 661 entirely. The side panels 610 are spaced such that the low-friction covers 659 limits or prevent lateral movement of the adjustable panel 630.

Referring again to FIGS. 1 and 2, the guide rail system 614 and the wrist systems 660 constrain the movement of the adjustable panel 630 such that each longitudinal position of the axis of rotation 642 corresponds to an orientation of the adjustable panel 630 about the axis of rotation 643. As discussed herein, the guide rail system 614 limits movement of the axis of rotation 642 to movement along the length of the pin slot 716. As the adjustable panel 630 moves longitudinally, the adjustable panel 630 slides within the slots 661 and the wrist bodies 662 rotate relative to the mounting plates 762. Contact between the adjustable panel 630 and the wrist system 660 causes angular positioning of the adjustable panel 630 about the axis of rotation 643.

Figure 3:
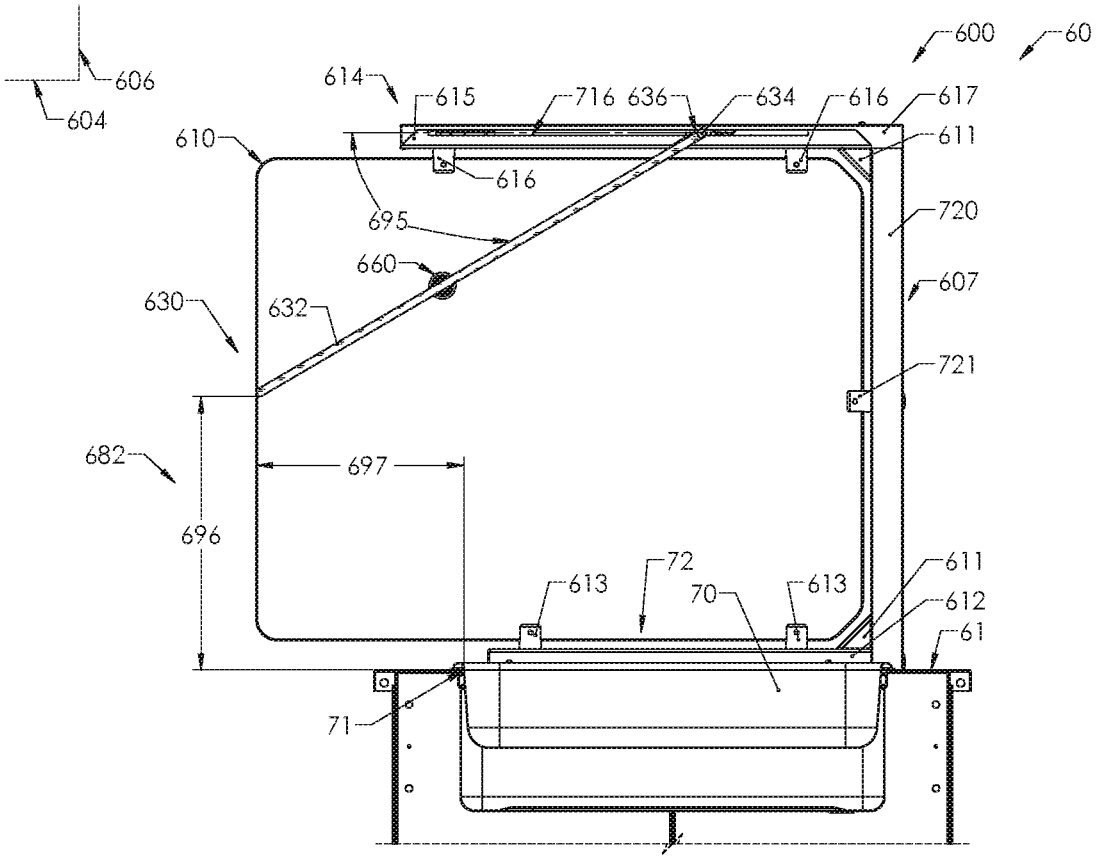
FIGS. 3 and 4 are side section views of the breath guard of FIG. 1.
Figure 4:
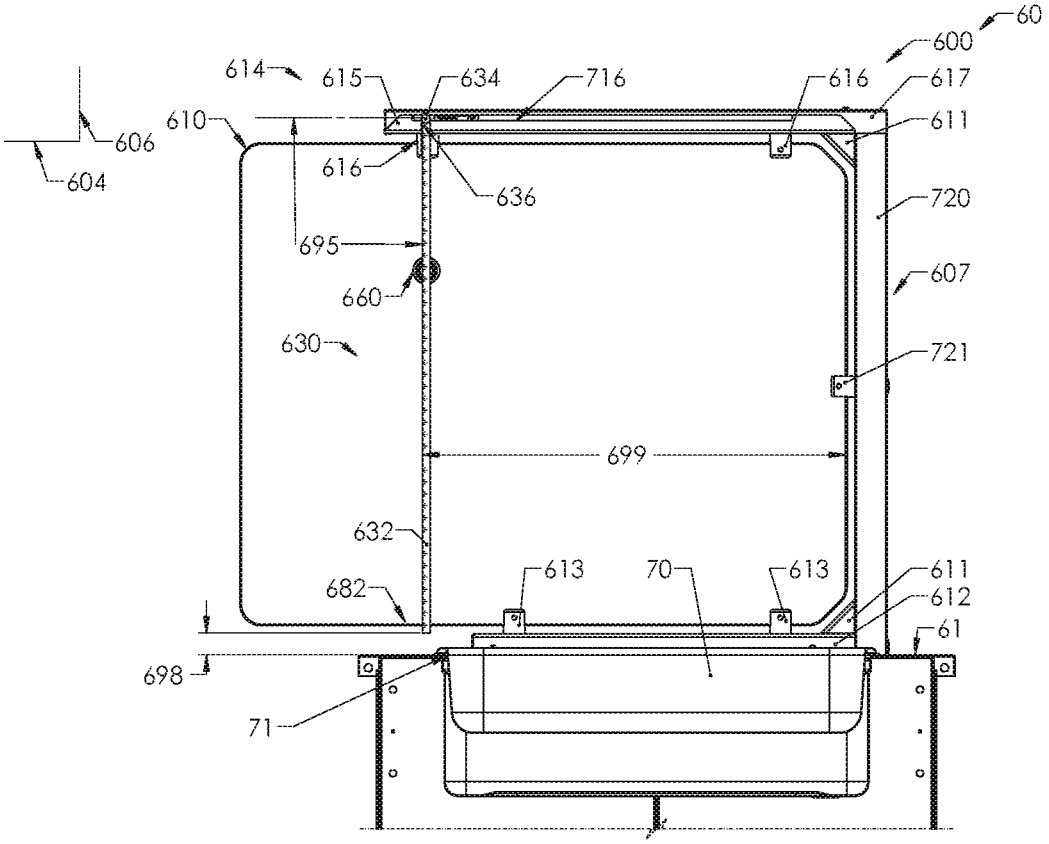

In some embodiments, the breath guard 600 is selectively reconfigurable into at least a self-service or buffet configuration, shown in FIGS. 1 and 3, and a full-service or cafeteria configuration, shown in FIG. 4. The user may reconfigure the breath guard 600 between the buffet configuration and the cafeteria configuration depending upon the task that will be performed by the breath guard 600. Due to the constraints on the motion of the adjustable panel 630 by the guide rail systems 614 and the wrist systems 660, the adjustable panel 630 may be selectively reconfigured between the two configurations by a single user by lifting or lowering an end of the adjustable panel 630.

In the buffet configuration shown in FIGS. 1 and 3, the adjustable panel 630 is angled (e.g., 165 degrees, 150 degrees, 135 degrees, 120 degrees, etc.) relative to a horizontal plane. An angle 695 is defined between the adjustable panel 630 and a horizontal plane (e.g., the horizontal plane along which the guide rail systems 614 extend). In some embodiments, the exact value of the angle 695 in the buffet configuration may be varied by the user (e.g., depending upon the user's preference). In other embodiments, the value of the angle 695 in the buffet configuration is fixed (e.g., by the geometry of the guide rail systems 614 and the locations of the wrist systems 660). In the buffet configuration, an aperture or opening 682 is formed between the top surface 61, the side panels 610, and the adjustable panel 630. The opening 682 facilitates access to the food pans 70 from a front side of the system 60 (e.g., the side opposite the spines 720). Such a configuration may be used in a self-service or buffet setting, where a customer reaches through the opening 682 to retrieve food from the food pans 70, serving themselves.

In the buffet configuration, a vertical distance, shown as distance 696, is defined between the lowest edge of the adjustable panel 630 and the top surface 61. The distance 696 may be sufficiently large such that a customer can access the food pans 70 through the opening 682. A horizontal distance, shown as distance 697, is defined between the frontmost edge of the adjustable panel 630 and a front edge 71 of the depression 72 of a food pan 70. In some embodiments, the distance 697 is set such that a front edge of each side panel 610 is aligned with the frontmost edge of the adjustable panel 630 in the buffet configuration.

In the cafeteria configuration shown in FIG. 4, the adjustable panel 630 is oriented substantially vertically (i.e., parallel to a vertical plane) such that the angle 695 is approximately 90 degrees. In other embodiments, the angle 695 has a value other than 90 degrees while in the cafeteria configuration. In the cafeteria configuration, the adjustable panel 630 extends between the top surface 61 and the side panels 610. Accordingly, the adjustable panel 630 prevents (i.e., blocks) access to the food pans 70 from the front side of the system 60 while in the cafeteria configuration. As such, the opening 682 is smaller in the cafeteria configuration than in the buffet configuration. The cafeteria configuration may be used in a full-service or cafeteria setting, where food service personnel stand on one side of the system 60 and serve food to a customer on the opposite side of the system 60. The system 60 permits access to the food pans 70 by the food service personnel from the rear side, but the adjustable panel 630 prevents access to the food pans 70 by the customers from the front side.

In the cafeteria configuration, a vertical distance, shown as distance 698, is defined between the lowest edge of the adjustable panel 630 and the top surface 61. A horizontal distance, shown as distance 699, is defined between the frontmost edge of the adjustable panel 630 and a rear edge of the side panels 610.

The breath guard 600 may be configured to conform to various standards for breath guards or food shields. By way of example, the breath guard 600 may be configured to conform to NSF/ANSI 2. Specifically, the cafeteria configuration of the breath guard 600 may correspond to an NSF cafeteria position conforming to NSF/ANSI 2 (e.g., at least the "food shields for use on cafeteria counters" section of NSF/ANSI 2, etc.), and the buffet configuration of the breath guard 600 may correspond to at least one NSF buffet positon conforming to NSF/ANSI 2 (e.g., at least the "self-service food shields" section of NSF/ANSI 2, etc.). In accordance with NSF/ANSI 2, a distance between the panel 632 and either of the side panels 610 may be a maximum of 0.75 inches (e.g., in both the NSF cafeteria position and the NSF buffet position). In the NSF cafeteria position, the distance 698 may be a maximum of 1.5 inches. In other embodiments, the breath guard functions as a device not specifically intended for use as a food shield or for food service. For example, in these embodiments, the breath guard may be a convertible shield/shelf device in which the device is usable as a shelf with the adjustable panel arranged horizontally and as a shield with adjustable panel arranged in other positions (e.g., a vertical position).

In the embodiment shown in FIG. 1, the mounting plate 762 is fixed relative to the side panels 610. In other embodiments, the wrist systems 660 are selectively repositionable relative to the side panels 610, thereby facilitating adjustment of the location of the axis of rotation 643. This facilitates adjustment of the orientation of the adjustable panel 630 for a given longitudinal position of the adjustable panel 630. By way of example, the mounting plate 762 may be slidably coupled to the corresponding side panel 610. By way of another example, the mounting plate 762 may be removed and replaced between a variety of different positions. The wrist systems 660 may be adjustable vertically (i.e., along the vertical axis 606) and/or longitudinally (i.e., along the longitudinal axis 604).

Figure 7:
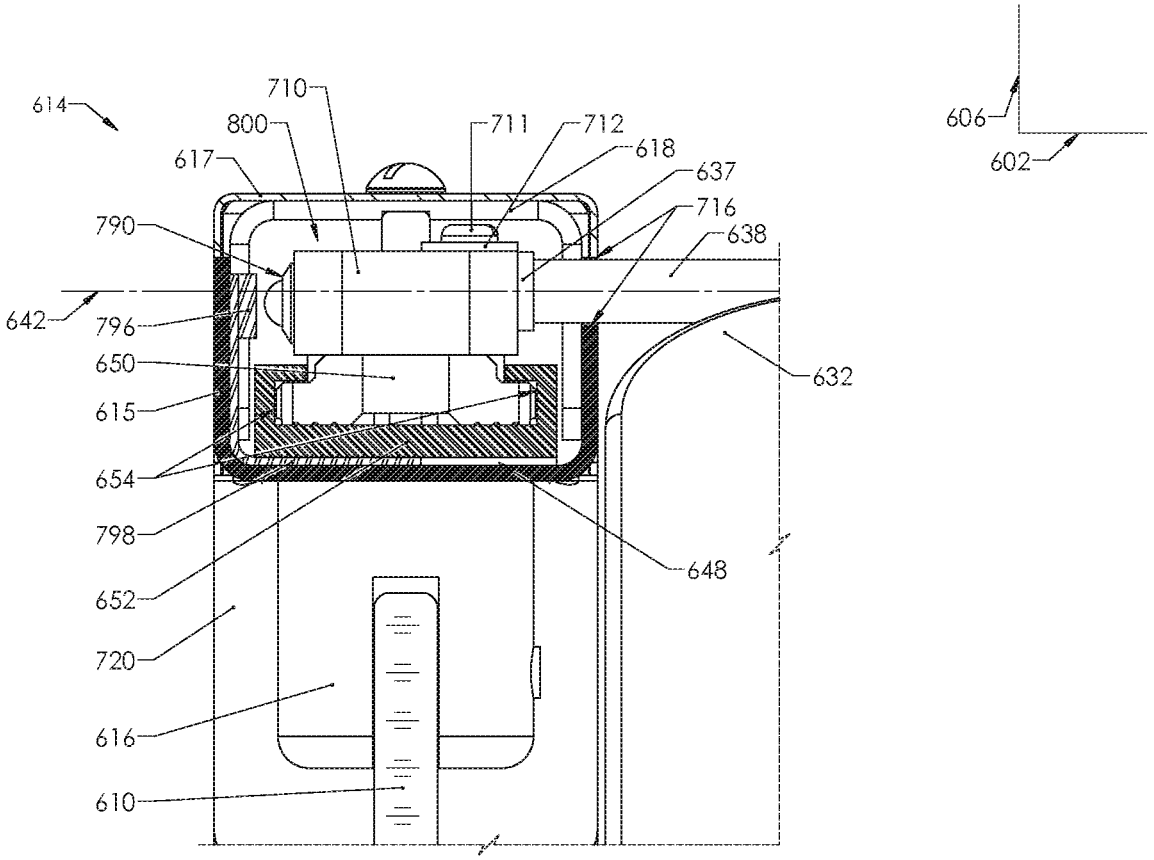
FIG. 7 is a front section view of a guide rail system of the breath guard of FIG. 1.

Referring to FIG. 7, the guide rail system 614 is shown according to an exemplary embodiment. The guide rail system 614 includes the frame rail 615 and the frame rail cover 617, both of which extend longitudinally. The frame rail 615 has an upward-facing U-shaped cross section, and the frame rail cover 617 has a downward-facing U-shaped cross section. Together, the frame rail 615 and the frame rail cover 617 define a volume, shown as frame rail volume 800, therebetween. When assembled, the frame rail 615 and the frame rail cover 617 define an outer surface of the guide rail system 614 that obscures components contained within the frame rail volume 800 from view. The frame rail 615 and the frame rail cover 617 also serve to reduce the likelihood of outside objects (e.g., user appendages, debris, etc.) entering the frame rail volume 800.

Contained within the frame rail volume 800 is a guide member, shown as guide rail 652. The guide rail 652 extends longitudinally along the length of the guide rail system 614. Referring again to FIG. 7, the guide rail 652 defines a pair of slots, shown as wing pockets 654, which extend longitudinally along the length of the guide rail 652. The wing pockets 654 each open toward a longitudinal centerline of the guide rail 652.

Figure 10:
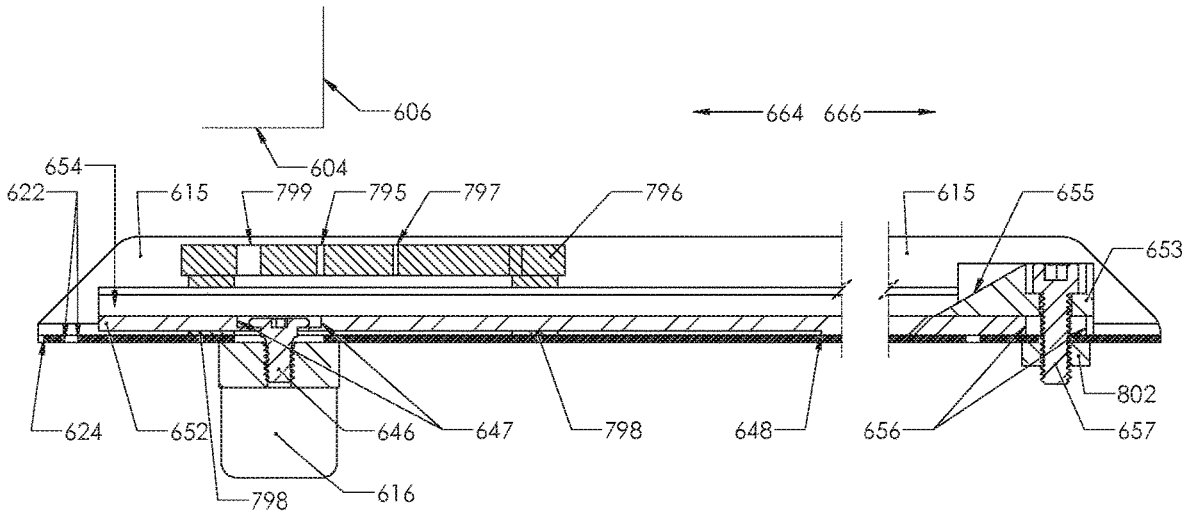
FIG. 10 is a side section view of the guide rail system of FIG. 7.
Figure 12:
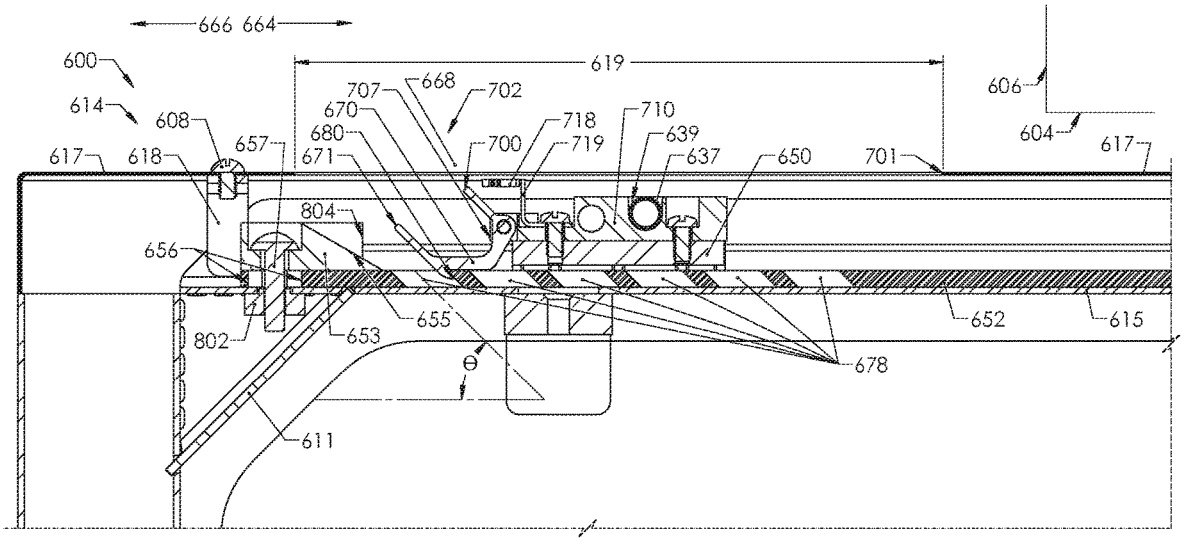
FIGS. 12-14 are side section views of the guide rail system of FIG. 7.

The guide rail 652 is coupled to the frame rail 615. Specifically, as shown in FIG. 10, a first fastener, shown as guide rail bolt 646, and a second fastener, shown as pawl ramp bolt 657, removably couple the guide rail 652 to the frame rail 615. The guide rail bolt 646 extends through apertures defined in the guide rail 652 and the frame rail 615 and threadedly engages one of the panel clips 616, coupling the panel clip 616 to the frame rail 615 as well. The head of the guide rail bolt 646 is received within a recess, shown as guide rail mounting slot 647, which extends longitudinally along the guide rail 652. The guide rail mounting slot 647 permits the head of the guide rail bolt 646 to sit below a top surface of the guide rail 652, permitting the passage of other components (e.g., the shuttle 650) along the guide rail 652. As shown in FIG. 12, the pawl ramp bolt 657 passes through an aperture of the guide rail 652, shown as guide rail mounting slot 656, and through an aperture of the frame rail 615 and threadedly engages a fastener, shown as nut 802. The nut 802 and the pawl ramp bolt 657 are obscured from view by one of the frame gussets 611. The guide rail mounting slot 647 and the guide rail mounting slot 656 extend longitudinally to permit longitudinal adjustment of the guide rail 652 position (e.g., by sliding the guide rail 652). Once the guide rail bolt 646 and the pawl ramp bolt 657 are tightened, the guide rail 652 is held in place relative to the frame rail 615.

Figure 8:
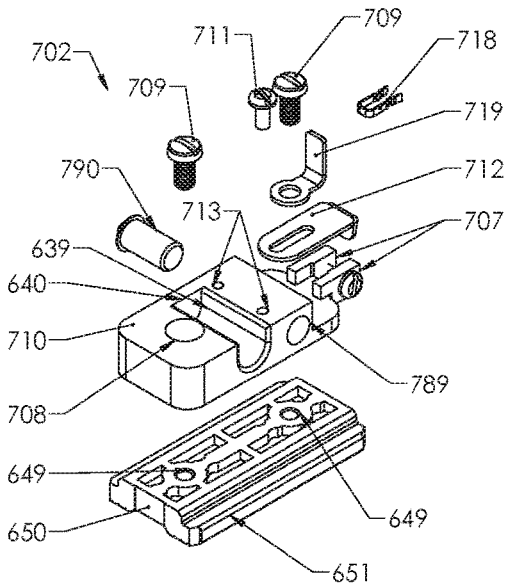
FIG. 8 is an exploded perspective view of a carriage system of the breath guard of FIG. 1.
Figure 9:
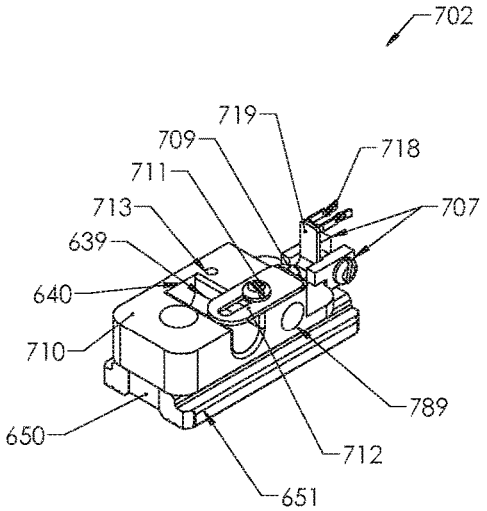
FIG. 9 is a perspective view of the carriage system of FIG. 8.

Referring to FIGS. 8 and 9, the guide rail system 614 further includes an assembly, shown as carriage system 702, that cooperates with the guide rail 652 to slidably couple the adjustable panel 630 to the frame rail 615. The carriage system 702 includes a base member, shown as shuttle 650. The shuttle 650 includes a pair of projections, shown as shuttle wings 651, which extend laterally outward from a longitudinal centerline of the shuttle 650. As shown in FIG. 7, the shuttle wings 651 are configured to be received within the wing pockets 654. The engagement between the shuttle wings 651 and the guide rail 652 slidably couples the shuttle 650 to the guide rail 652. The shuttle wings 651 and the guide rail 652 are correspondingly shaped, preventing relative lateral and vertical movement, but permitting free longitudinal movement of the shuttle 650. The shuttle 650 further defines a pair of apertures, shown as threaded apertures 649. In some embodiments, the shuttle 650 is formed from plastic, and the threaded apertures 649 are defined by threaded metal inserts. Forming the shuttle 650 from plastic may help to absorb impacts and minimize friction between the shuttle 650 and the guide rail 652. The threaded metal inserts provide a robust threaded connection.

Referring again to FIGS. 8 and 9, the carriage system 702 further includes a main body, shown as carriage 710. The carriage 710 defines a pair of vertically-extending apertures, shown as mounting holes 708. A pair of fasteners, shown as mounting bolts 709, extend through the mounting holes 708 and engage the threaded apertures 649, coupling the carriage 710 to the shuttle 650.

Referring to FIGS. 7-9, 12, and 18, the carriage 710 further defines a recess, shown as pin saddle 639. The pin saddle 639 extends downward from a top surface of the carriage 710 and laterally from a side of the carriage 710. Accordingly, the pin saddle 639 defines a pair of openings: one along the top side of the carriage 710 and one along an inside surface of the carriage 710 that faces laterally inward. A wall, shown as saddle wall 640, is positioned along the pin saddle 639 opposite the lateral opening. The pin saddle 639 is configured to receive the hanger pin 638 to pivotally couple the adjustable panel 630 to the carriage system 702. The hanger pin 638 extends laterally outward, through the pin slot 716, and into the pin saddle 639. A sleeve or spacer, shown as hanger pin cap 637, receives the hanger pin 638. The hanger pin cap 637 extends between and engages the hanger pin 638 and the walls of the pin saddle 639. An inner diameter of the hanger pin cap 637 is substantially equal to an outer diameter of the hanger pin 638, and an outer diameter of the hanger pin cap 637 is substantially equal to the width (e.g., measured longitudinally) and height (e.g., measured vertically) of the pin saddle 639. The hanger pin cap 637 extends between the hanger pin 638 and the saddle wall 640. A retainer, shown as captured tab 712, extends across a top opening of the pin saddle 639. A fastener, shown as captured tab bolt 711 extends through an aperture defined in the captured tab 712 and threadedly engages an aperture or recess defined in the carriage 710, shown as pilot hole 713, coupling the captured tab 712 to the carriage 710.

As shown in FIG. 8, the carriage 710 defines two of the pilot holes 713, although only one is used at any given time. The same carriage 710 may be used in both guide rail systems 614, and a different pilot hole 713 may be used depending upon which guide rail system 614 utilizes the carriage 710. Including two of the pilot holes 713 facilitates using the same carriage 710 in both of the guide rail systems 614, reducing the unique part count of the breath guard 600. By way of example, the pilot holes 713 may be cast or molded into the carriage 710, and the pin saddle 639 may later be machined into the carriage 710. By way of another example, the carriage 710 may be cast or molded with the pin saddle 639 extending across the entire width of the carriage 710, and the saddle wall 640 may later be added (e.g., adhered, fastened, welded, etc.) to the carriage 710.

The saddle wall 640 and the captured tab 712 retain the hanger pin 638 within the pin saddle 639, limiting lateral movement, and preventing longitudinal and vertical movement, of the adjustable panel 630 relative to the carriage system 702 while facilitating rotation of the adjustable panel 630 about the axis of rotation 642, shown in FIG. 7 as extending through the center of the hanger pin 638. Engagement between the front and rear walls of the pin saddle 639 and the hanger pin cap 637 limits (e.g., prevents) longitudinal movement of the hanger pin 638 relative to the carriage 710. Engagement between the bottom wall of the pin saddle 639 and the captured tab 712 and the hanger pin cap 637 limits (e.g., prevents) vertical movement of the hanger pin 638 relative to the carriage 710. Engagement between the hanger pin cap 637 and the saddle wall 640 limits (e.g., prevents) outward lateral movement of the hanger pins 638. The breath guard 600 includes two of the carriage systems 702 symmetrically arranged on each side of the adjustable panel 630. Accordingly, the saddle walls 640 of both carriage systems 702 cooperate to limit (e.g., prevent) lateral movement of the adjustable panel 630. The hanger pin cap 637 and the pin saddle 639 may be correspondingly sized to limit rotation of the adjustable panel 630 about a vertical axis relative to the carriage 710 (e.g., rotating the axis of rotation 642 out of perpendicularity with the guide rail systems 614). The materials of the hanger pin cap 637 and/or the carriage 710 may be compliant (e.g., plastic) to permit some rotation of the adjustable panel 630 about the vertical axis. By way of example, this may account for some non-parallelism between the guide rails 652. In addition, the allowance of some lateral displacement, by the use of opposing saddle walls 640, accommodates non-parallelism between the guide rails 652. This may facilitate installation of the side frame assemblies 607 by an unskilled operator without any specialized tools or equipment. The materials of the hanger pin cap 637 and/or the carriage 710 may be configured to facilitate rotation of the hanger pin 638 about the axis of rotation 642 relative to the hanger pin cap 637 and/or the carriage 710.

To remove the adjustable panel 630 from the carriage system 702, a user may loosen the captured tab bolt 711 and rotate the captured tab 712 away from the pin saddle 639. The aperture of the captured tab 712 that receives the captured tab bolt 711 may be elongated (e.g., slotted) to facilitate this movement. The adjustable panel 630 may then be lifted straight upward out of the pin saddle 639. This process may be completed without removing the captured tab bolt 711, minimizing the potential loss of parts.

Referring to FIG. 11, the carriage system 702 is configured to travel longitudinally through a series of different zones. Because of the constraints that the wrist systems 660 and the carriage system 702 apply to the adjustable panel 630, every longitudinal position of the carriage system 702 corresponds to an orientation of the adjustable panel 630. FIG. 11 indicates two longitudinal directions: a first longitudinal direction 664 that extends toward the customer in the cafeteria configuration and a second longitudinal direction 666 that extends away from the customer in the cafeteria configuration. Accordingly, each zone corresponds to a different position and orientation of the adjustable panel 630 and a different function of the breath guard 600. Proceeding along the guide rail 652 in the first direction, the carriage system 702 travels through: a cleaning or loading zone 691, a self-service or buffet zone 690 (corresponding to the buffet configuration), a transition zone 694, an arresting zone 693, a full-service or cafeteria zone 692 (corresponding to the cafeteria configuration), and an over-travel zone 689. The positions of the adjustable panel 630 associated with these zones are shown in FIG. 2.

Referring to FIGS. 11 and 12, one or both of the guide rail systems 614 include an adjustment mechanism 668 configured to selectively hold the adjustable panel 630 in a series of different longitudinal positions. Each adjustment mechanism 668 includes a pawl 670 pivotally coupled to the carriage 710 such that the pawl 670 rotates about a lateral axis. The guide rail 652 defines one or more apertures, slots, or recesses, shown as pawl apertures 678, configured to cooperate with the pawl 670 to selectively prevent longitudinal movement of the adjustable panel 630 in the first longitudinal direction 664 and to permit movement in the second longitudinal direction 666. The carriage system 702 and the pawl 670 are configured to move longitudinally in unison with the adjustable panel 630. In other embodiments, the pawl apertures 678 are defined by another component of the guide rail system 614 (e.g., the frame rail 615, an additional component, etc.).

The pawl 670 includes a protrusion, shown as tooth 680, configured to extend into the pawl apertures 678 to selectively prevent movement of the adjustable panel 630 in the first longitudinal direction 664. The pawl apertures 678 extend through the guide rail 652 at an angle θ relative to a horizontal plane. As shown in FIG. 12, the angle θ is approximately 45 degrees. In other embodiments, the angle θ is another angle (e.g., 30 degrees, 60 degrees, 90 degrees, etc.). The angle θ is oriented such that the pawl apertures 678 extend upward along the second longitudinal direction 666. The pawl apertures 678 each have a circular cross section. By way of example, the pawl apertures 678 may be formed using a circular drill oriented at the angle θ. The tooth 680 has a shape and orientation corresponding to the shapes of the pawl apertures 678. Accordingly, the tooth 680 has a circular curvature and extends at the angle θ. By way of example, the tooth 680 may be formed using a dovetail mill. This corresponding shape and orientation facilitates full engagement between the tooth 680 and the guide rail 652. In other embodiments, the pawl apertures 678 have another cross-sectional shape (e.g., square, rectangular, triangular, etc.). The tooth 680 may be configured with a corresponding shape and orientation.

The pawl 670 is biased toward the guide rail 652 by the force of gravity acting on the pawl 670. In a ratcheting or activated configuration of the adjustment mechanism 668, the pawl 670 moves freely, and gravity causes the pawl 670 to rest against the guide rail 652. When a force is applied to the adjustable panel 630 in the second longitudinal direction 666, the pawl 670 slides freely in the second longitudinal direction 666. As the tooth 680 passes over one of the pawl apertures 678, gravity forces the tooth 680 into the pawl aperture 678. Accordingly, no springs or other biasing members are required to force the pawl 670 into engagement with the pawl apertures 678. A back surface of the pawl 670 is angled such that further force on the second longitudinal direction 666 causes the tooth 680 to engage the guide rail 652 and rise out of the pawl aperture 678. The pawl 670 may have a sufficient length such that the main body of the pawl 670 rides atop the guide rail 652 instead of falling into the pawl apertures 678 when the tooth 680 is not engaging the guide rail 652. When a force is applied to the adjustable panel 630 in the first longitudinal direction 664, the pawl 670 moves along the guide rail 652 until the tooth 680 drops into one of the pawl apertures 678. The tooth 680 then engages the angled surface of the guide rail 652 along the pawl aperture 678. Due to the corresponding shapes and orientations of the tooth 680 and the pawl aperture 678, continuing to apply a force to the adjustable panel 630 in the first longitudinal direction 664 will cause the tooth 680 to be driven downward, further engaging the guide rail 652 and holding the pawl 670 in place. The pawl 670 then prevents the carriage system 702 and the adjustable panel 630 from moving in the first longitudinal direction 664.

When the adjustable panel 630 is not in the cafeteria configuration (e.g., the angle 695 90 degrees), the force of gravity biases the adjustable panel 630 to slide forward through the slots 661, moving the adjustable panel 630 in the first longitudinal direction 664. Accordingly, when the tooth 680 is inserted into a pawl aperture 678, the tooth 680 engages the guide rail 652, and the pawl 670 opposes the force of gravity. If the user releases the adjustable panel 630 when the carriage system 702 is located in the loading zone 691 or the buffet zone 690 and the tooth 680 is not already fully engaged within a pawl aperture 678, the adjustable panel 630 will move in the first longitudinal direction 664 until the tooth 680 automatically enters one of the pawl apertures 678 and engages the guide rail 652. To free the tooth 680 from a pawl aperture 678, the user can simply apply a force in the second longitudinal direction 666. Such an arrangement automatically prevents the adjustable panel 630 from moving in the first longitudinal direction 664 under the weight of the adjustable panel 630, while still allowing a user to freely push or pull the adjustable panel 630 in the second longitudinal direction 666.

The angle 695 may be adjusted by selectively repositioning the adjustable panel 630 such that the pawl 670 engages a different one of the pawl apertures 678. As shown in FIG. 11, the pawl apertures 678 are positioned such that the pawl 670 engages the pawl apertures 678 when the carriage system 702 is in the loading zone 691 or the buffet zone 690. When the pawl 670 engages the pawl aperture 678 that is positioned furthest in the first longitudinal direction, the adjustable panel 630 is in the buffet configuration. When the adjustable panel 630 is moved in the second longitudinal direction 666 from the buffet configuration, the carriage system 702 enters the loading zone 691 and may engage any of the other pawl apertures 678 to hold the adjustable panel 630 in a cleaning or loading configuration. Certain parts of the breath guard 600 may be easier to access for maintenance and cleaning when the adjustable panel 630 is in the loading configuration. Specifically, holding the front edge of the adjustable panel 630 higher and further back facilitates user access to the entirety of the cabinet top 61 (e.g., for cleaning, for easier access when replacing the food pans 70). By way of example, a user may move the adjustable panel 630 into the loading configuration when replacing an empty food pan 70 with a food pan 70 that has been replenished with food. This improved accessibility may facilitate avoiding contact with hot food or steam.

Because the pawl 670 engages a pawl aperture 678 when entering the buffet configuration, the adjustable panel 630 quickly and easily reaches a precise position and orientation every time that adjustable panel 630 is reconfigured into the buffet configuration. This exact placement of the adjustable panel is especially useful when locating multiple breath guards 600 next to one another, as consistent alignment of the adjustable panel 630 is visibly noticeable between adjacent breath guards 600.

In alternative embodiments, the pawl 670 is replaced with a binding mechanism that selecitvely binds (e.g., against the guide rail 652) to resist movement of the adjustable panel 630 in the first longitudinal direction 664. This binding may occur in any position (e.g., an infinite number of positions) as opposed to the discrete positions of the pawl apertures 778. In an activated configuration, the binding mechanism resists movement of the carriage system 702 along a predetermined section of the guide rail 652 while permitting free movement of the carriage system 702 in the second longitudinal direction 666. In a deactivated configuration, the binding mechanism permits free movement of the carriage system 702 in both the first longitudinal direction 664 and the second longitudinal direction 666 along the entire length of the guide rail 652. In some such embodiments, the binding mechanism uses friction to cause the binding (e.g., friction between two materials, friction between textured surfaces, etc.). Additionally or alternatively, the binding mechanism may utilize features that catch upon one another (e.g., a rack and pawl), to resist movement of the carriage system 702 in the first longitudinal direction 664.

Referring again to FIGS. 8 and 9, the carriage system 702 includes a logic resetting member, spring clip, or coupler, shown as catch tab clip 718. The catch tab clip 718 is coupled to the carriage 710 by a bracket or mount, shown as clip bracket 719. In other embodiments, the catch tab clip 718 and the clip bracket 719 are the same component. In yet other embodiments, the clip bracket 719 is omitted, and the carriage 710 extends up to meet the catch tab clip 718. The clip bracket 719 defines an aperture that receives one of the mounting bolts 709. The catch tab clip 718 defines a recess extending in the second longitudinal direction 666. The recess necks down (e.g., narrows) partway along its length, then expands near the clip bracket 719. The catch tab clip 718 is made from a resilient material (e.g., spring steel) that is configured to return to its original shape after being deformed.

Referring to FIG. 12, the pawl 670 further includes a first protrusion or projection, shown as catch tab 700, and a second protrusion or projection, shown as pawl flag 671. The catch tab 700 and the pawl flag 671 are offset from one another. In some embodiments, the catch tab 700 and the pawl flag 671 are substantially parallel to one another. The pawl flag 671 is positioned farther from the axis of rotation of the pawl 670 than the catch tab 700.

The guide rail system 614 further includes a block, shown as pawl ramp 653. The pawl ramp 653 is coupled to the guide rail 652 by the pawl ramp bolt 657. The pawl ramp bolt 657 passes through an aperture defined by the pawl ramp 653 and an aperture defined by the frame rail 615. In some embodiments, the pawl ramp bolt 657 fits tightly to these apertures to hold the pawl ramp 653 in a predetermined position relative to the frame rail 615. The pawl ramp 653 is positioned at the end of the guide rail 652 that is farthest in the second longitudinal direction 666. The pawl ramp 653 defines a surface, shown as ramp face 655. The ramp face 655 extends upward in the second longitudinal direction 666. In some embodiments, the ramp face 655 is substantially flat.

Referring to FIGS. 12-15, as the carriage system 702 nears the end of the guide rail 652, the tooth 680 rides up out of the last pawl aperture 678 and engages the ramp face 655. If the carriage system 702 continues to move in the second longitudinal direction 666, the ramp face 655 forces the pawl 670 to rotate upward. Eventually, the pawl 670 rotates upward to the point where the catch tab 700 engages the catch tab clip 718. Further movement in the second longitudinal direction 666 forces the catch tab 700 through the narrow portion of the catch tab clip 718, bending the catch tab clip 718 outwards. The catch tab clip 718 then returns to its original position, and the catch tab clip 718 holds the catch tab 700 in place. This is considered a freewheeling or deactivated configuration of the adjustment mechanism 668. In some embodiments, the guide rail system 614 is configured to resist movement of the carriage system 702 in the second longitudinal direction 666 when the pawl 670 engages the pawl ramp 653, alerting the user that the adjustment mechanism 668 is about to enter the deactivated configuration. By way of example, a biasing element (e.g., a spring) may be coupled to the pawl ramp 653 such that the spring engages the carriage system 702 when the carriage system 702 is near the pawl ramp 653, biasing the carriage system 702 away from the pawl ramp 653.

Referring to FIGS. 8-10, 13, and 14, the carriage system 702 further includes a pair of stop blocks, shown as travel rams 707. The travel rams 707 are coupled to the carriage 710 and positioned on opposite sides of the pawl 670. The pawl ramp 653 defines a pair of stop surfaces 804 each positioned on opposite sides of the ramp face 655. In some embodiments, the stop surfaces 804 are substantially vertical. In other embodiments, the pawl ramp 653 defines more or fewer travel rams 707 and stop surfaces 804 (e.g., one, three, four, etc.). Once the carriage system 702 has been moved far enough in the second longitudinal direction 666 to move the pawl 670 into the deactivated configuration, the travel rams 707 engage the stop surfaces 804, preventing further movement of the carriage system 702 in the second longitudinal direction 666.

Referring to FIGS. 14 and 15, in the deactivated configuration, the catch tab clip 718 holds the pawl 670 out of engagement with the guide rail 652 such that the carriage system 702 is free to move in the first longitudinal direction 664. The catch tab 700 and the pawl flag 671 extend upward through a slot or aperture, shown as flag slot 619, defined by the frame rail cover 617. Specifically, the catch tab 700 extends into the flag slot 619, and the pawl flag 671 extends through the flag slot 619 and above the top surface of the frame rail cover 617 such that the pawl flag 671 is visible to the user. In some embodiments, the pawl flag 671 is made a vibrant color (e.g., red, orange, yellow, etc.) to attract the user's attention. The visibility of the pawl flag 671 indicates to the user that the pawl 670 is in a deactivated configuration, and the adjustable panel 630 is free to move in the first longitudinal direction 664 from, for example, the influence of gravity.

Figure 16:
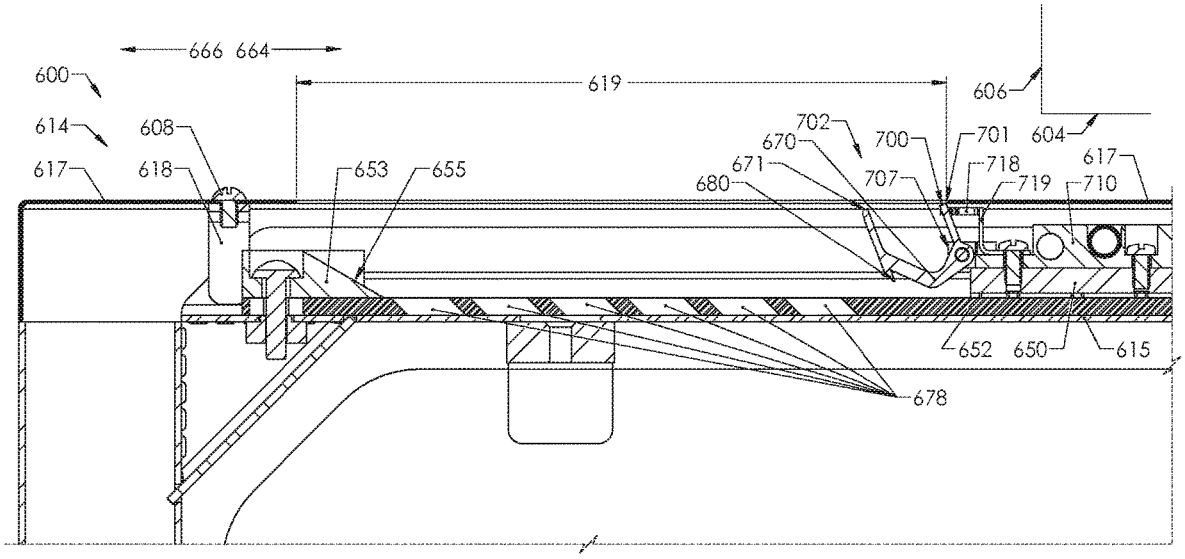
FIG. 16 is a side section view of the guide rail system of FIG. 1.

Referring to FIGS. 14 and 16, to return the pawl 670 to the activated configuration, the carriage system 702 is moved in the first longitudinal direction 664. When the catch tab 700 reaches the end of the flag slot 619, the catch tab 700 engages an edge or surface, shown as pawl reset edge 701, of the frame rail cover 617. Moving the carriage system 702 further in the first longitudinal direction 664 causes the pawl reset edge 701 to force the catch tab 700 out of the catch tab clip 718, and the pawl 670 returns to the activated configuration. The pawl 670 then falls downward to engage the guide rail 652. In this position, shown in FIG. 16, the carriage system 702 is positioned far enough in the first longitudinal direction 664 that the tooth 680 will not engage any of the pawl apertures 678 until the carriage system 702 is again moved in the second longitudinal direction 666. If the carriage system 702 is moved a sufficient distance in the second longitudinal direction 666 from this position, the tooth 680 will next engage the pawl aperture 678 corresponding to the buffet configuration and will hold the adjustable panel 630 in the buffet configuration if released there by the user.

Figure 17:
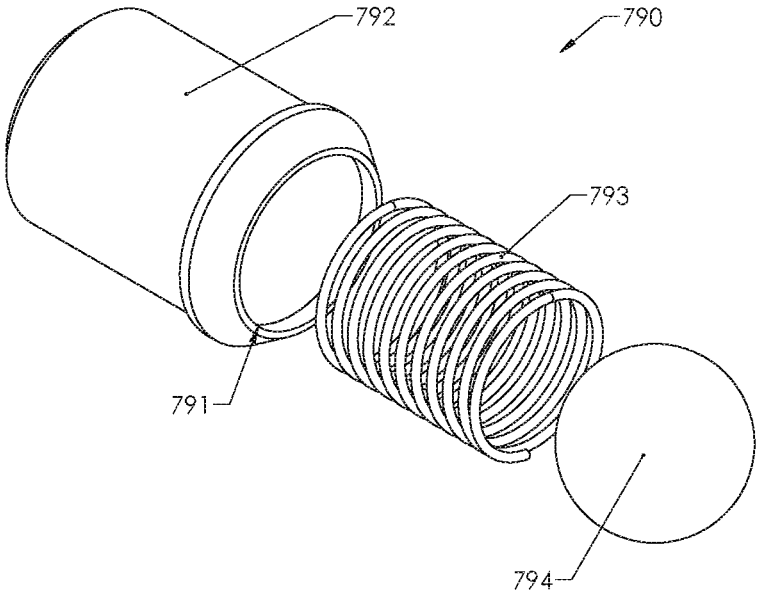
FIG. 17 is an exploded perspective view of a plunger assembly of the carriage system of FIG. 8.

Referring to FIGS. 8 and 17, the carriage system 702 includes a detent assembly or biasing assembly, shown as plunger assembly 790. The carriage 710 defines an aperture or recess, shown as plunger aperture 789, configured to receive the plunger assembly 790. The plunger aperture 789 extends laterally such that the plunger assembly 790 is oriented laterally. The plunger aperture 789 extends entirely through the carriage 710 such that the plunger assembly 790 can be inserted into either lateral side of the carriage 710. This facilitates using the same carriage 710 in both of the guide rail systems 614, reducing the unique part count of the breath guard 600. The plunger assembly 790 includes a receiving member, can, or cup, shown as body 792. The body 792 defines an aperture configured to receive a biasing member, shown as spring 793, and a ball, shown as plunger 794. The plunger 794 is translatably coupled to the body 792. The spring 793 is a compression spring positioned between the body 792 and the plunger 794 such that the spring 793 biases the plunger 794 out of the body 792. The body 792 is formed with an internal crimp or lip 791 to prevent the plunger 794 from leaving the body 792. The lip 791 may be formed after the plunger 794 is inserted into the body 792. In some embodiments, the plunger 794 is spherical. The plunger assembly 790 may be preassembled and inserted into the plunger aperture 789. This may facilitate precise control of the compression of the spring 793 and simplify machining and assembly of the carriage 710.

Figure 18:
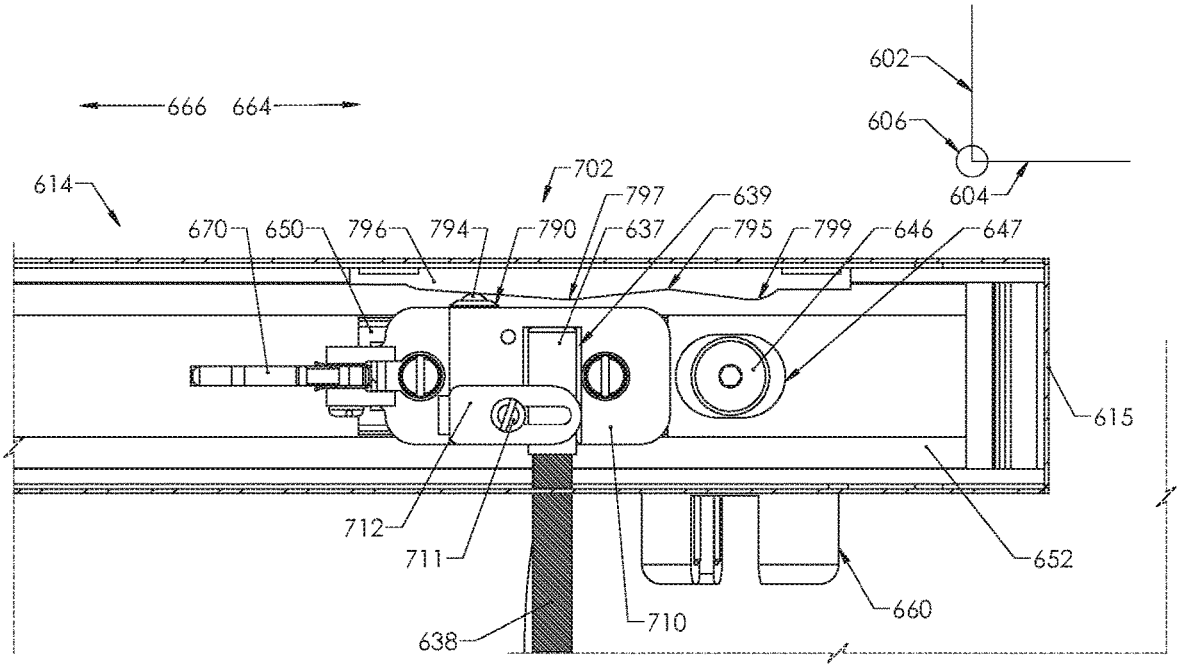
FIGS. 18-21 are top section views of the guide rail system of FIG. 1.
Figure 19:
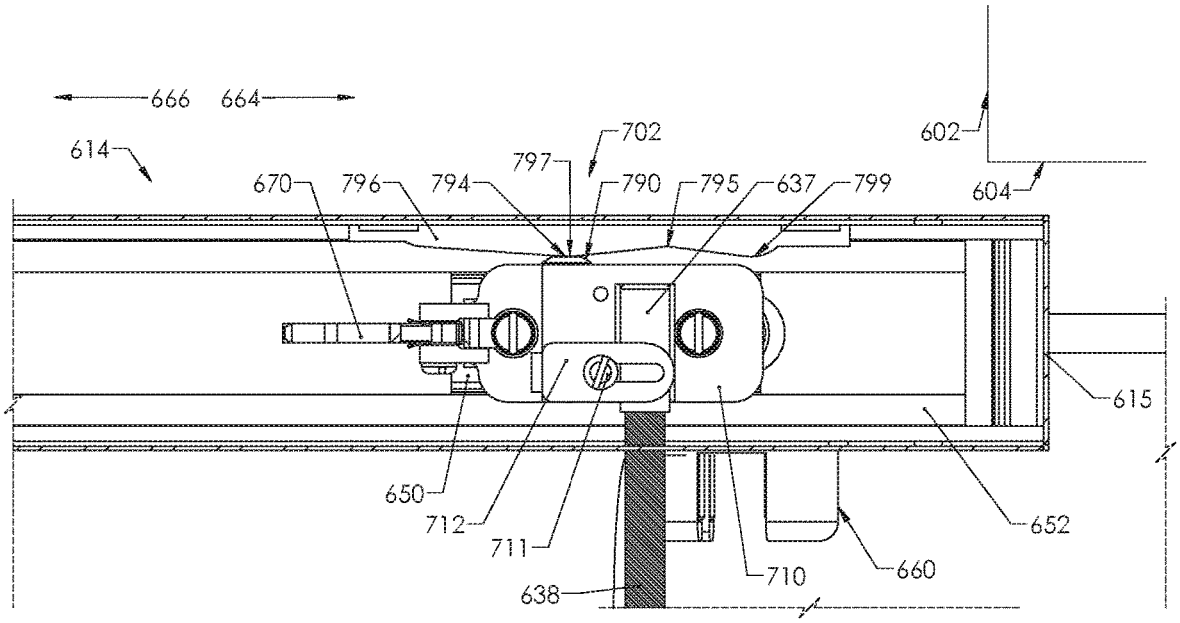

Referring to FIGS. 7, 10, and 18, the guide rail system 614 includes a ramped block, shown as motion control device 796. The motion control device 796 is positioned laterally outward from the carriage system 702 and arranged along a wall of the frame rail 615. The motion control device 796 is coupled to a pair of plates, shown as mounting tabs 798, that extend downward and under the guide rail 652. Specifically, the guide rail 652 defines a recess, shown as pinch provision 648, into which the mounting tabs 798 are inserted. The mounting tabs 798 are clamped between the frame rail 615 and the guide rail 652, holding the motion control device 796 in place. To adjust the longitudinal position of the motion control device 796, the guide rail bolt 646 can be loosened, and the motion control device 796 can be slid into the desired position. The vertical position of the motion control device 796 is defined by the geometry of the mounting tabs 798. The use of the pinch provision 648 facilitates mounting the motion control device 796 without additional fasteners. The pinch provision 648 extends along only a portion of the length of the guide rail 652. As such, a bottom surface of the guide rail 652 engages the frame rail 615, maintaining both (a) a desired distance between the carriage system 702 and the frame rail 615 and (b) the guide rail 652 parallel to the frame rail 615. This ensures that the hanger pin 638 does not contact the bottom or top surfaces of the pin slot 716.

Referring to FIGS. 18-21, the plunger 794 is configured to engage the motion control device 796 to control the motion of the carriage system 702. The spring 793 biases the plunger 794 into engagement with the surface of the motion control device 796. The thickness (e.g., measured in the lateral direction) of the motion control device 796 varies longitudinally. As the carriage system 702 moves the plunger 794 longitudinally along the surface, the spring 793 is compressed or expands depending upon the thickness of the motion control device 796. When the plunger 794 moves along a section where the thickness increases, a greater longitudinal force must be applied to the carriage system 702 to compress the spring 793. Conversely, when the plunger 794 moves along a section where the thickness decreases, the spring 793 lessens the force required to move the carriage system 702 and/or may drive the carriage system 702 without input from the user (e.g., to the cafeteria detent 795). The amount of energy required to move the carriage system 702 along the guide rail 652 may vary depending upon the slope of the thickness of the motion control device 796, the spring rate of the spring 793, and the materials of the various components.

When moving the carriage system 702 in the first longitudinal direction 664, the plunger 794 first engages the motion control device 796 near the end of the guide rail 652. Moving in the first longitudinal direction 664, the thickness of the motion control device 796 first increases, compressing the plunger assembly 790 and storing energy. This helps dissipate any momentum generated by the force of gravity on the adjustable panel 630. The thickness of the motion control device 796 peaks at a hill or peak, shown as slow-to-home transition 797. Beyond the slow-to-home transition 797, the thickness decreases, releasing energy from the plunger assembly 790 until reaching a recess, shown as full-service detent or cafeteria detent 795. Beyond the cafeteria detent 795, the thickness increases toward a hill or peak, shown as limit of over-travel 799. When the plunger assembly 790 is between the slow-to-home transition 797 and the limit of over-travel 799, the spring 793 biases the plunger assembly 790 toward the cafeteria detent 795. When the plunger 794 is received within the cafeteria detent 795, the adjustable panel 630 is in the cafeteria configuration. The increase in thickness toward the limit of over-travel 799 resists movement in the first longitudinal direction 664, warning the user that they have moved the adjustable panel 630 beyond the cafeteria configuration. Because the thickness of the motion control device 796 increases on each side of the cafeteria detent 795, the plunger assembly 790 biases the adjustable panel 630 toward the cafeteria configuration when the plunger 794 is between the slow-to-home transition 797 and the limit of over-travel 799.

It is advantageous to include the gradual increase in thickness of the motion control device 796 between the cafeteria detent 795 and the limit of over-travel 799 as opposed to introducing a hard stop at the cafeteria detent 795. Whereas a hard stop would not permit any movement beyond the cafeteria detent 795, the gradual increase in thickness permits, but resists, some motion of the adjustable panel 630 beyond the cafeteria configuration. If the plunger assembly 790 were to be moving quickly toward the cafeteria detent 795, a hard stop would arrest the movement of the adjustable panel 630 very quickly, introducing high forces and potentially damaging components. The motion control device 796 and the plunger assembly 790 cooperate to slow the adjustable panel 630 more slowly, reducing forces and the potential for damage.

The guide rail systems 614 are configured to prevent movement of the plunger assemblies 790 in the first longitudinal direction 664 beyond the limit of over-travel 799. The slope of the surface of the motion control device 796 and/or the characteristics of the plunger assembly 790 may be configured to prevent further movement. The thickness of the motion control device 796 may be increased to the point where the plunger assembly 790 interferes with the motion control device 796 to prevent further movement. A stop may be added (e.g., to the motion control device 796, to the guide rail 652, etc.) that engages the shuttle 650 and/or the carriage 710 to prevent further movement.

To adjust the position of the adjustable panel 630, a user may impart a longitudinal force on the adjustable panel 630 (e.g., above the wrist systems 660), or the user may apply a lifting force to the adjustable panel 630 (e.g., below the wrist systems 660). Throughout at least a portion of the range of motion of the adjustable panel 630, the weight of the adjustable panel 630 biases the adjustable panel 630 toward the cafeteria configuration.

To move the adjustable panel 630 in the second longitudinal direction 666, a user may simply lift upward on the adjustable panel 630 or impart a force on the adjustable panel 630 in the second longitudinal direction 666. When starting in the cafeteria configuration, the adjustable panel 630 is held in place by the biasing forces of the plunger assemblies 790 engaging the corresponding cafeteria detents 795. As the adjustable panel 630 is moved toward the buffet configuration, these biasing forces are overcome by the user. Collectively, these biasing forces prevent the adjustable panel 630 from accidentally being moved out of the cafeteria configuration, but do not hinder the movement of the adjustable panel 630 once the adjustable panel 630 is a sufficient distance from the cafeteria configuration.

As the adjustable panel 630 moves toward the buffet configuration, the plunger 794 is depressed, hindering the movement of the adjustable panel 630, until the plunger 794 meets the slow-to-home transition 797. As the plunger 794 crests the slow-to-home transition 797, the plunger 794 extends laterally outward, assisting the movement of the adjustable panel 630. After the plunger 794 is no longer in contact with the motion control device 796, the plunger 794 no longer affects the movement of the adjustable panel 630.

Figure 13:
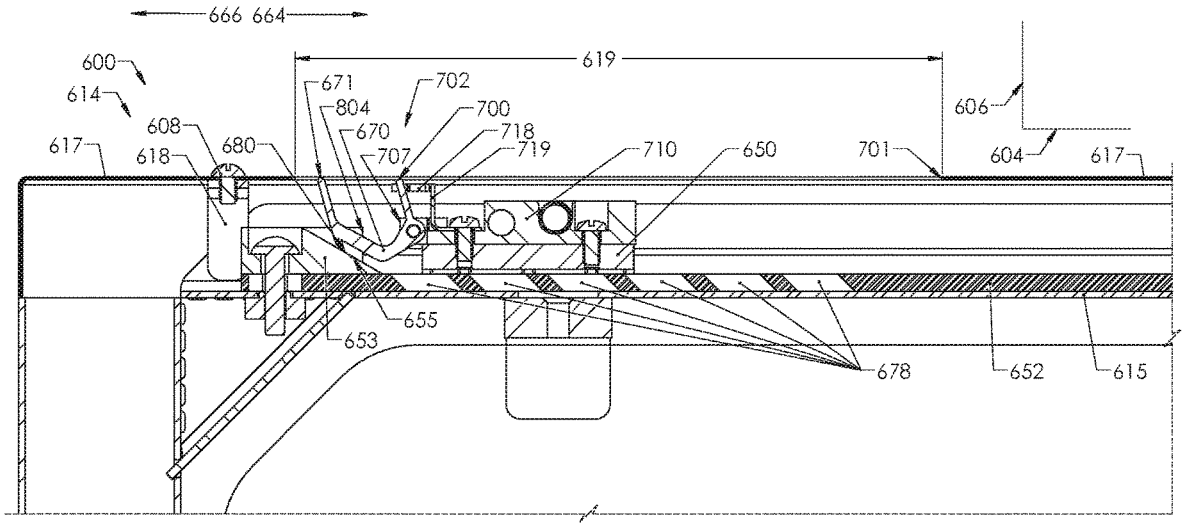

Referring to FIGS. 12-14, the user may then move the adjustable panel 630 until the pawl 670 engages the pawl aperture 678 corresponding to the buffet configuration. At this point, the adjustment mechanism 668 holds the adjustable panel 630 in in the buffet configuration, and the user may release the adjustable panel 630 without the adjustable panel 630 falling. The user may continue to lift upward on the adjustable panel 630 until the pawl 670 engages another of the pawl apertures 678. This corresponds to the cleaning configuration and has a shallower angle 695 than the buffet configuration. As the pawl 670 nears the end of the guide rail 652, the pawl 670 engages the ramp face 655. The user can continue to move the adjustable panel 630 in the second longitudinal direction 666 until the catch tab 700 is received by the catch tab clip 718. At this point, the pawl flag 671 extends out of the flag slot 619, alerting the user that the adjustable panel 630 can now freely move in the first longitudinal direction 664.

The adjustable panel 630 may then be lowered by the user toward the cafeteria configuration. Referring to FIG. 16, as the catch tab 700 reaches the end of the flag slot 619, the catch tab 700 engages the pawl reset edge 701, and the pawl 670 rotates out of engagement with the catch tab clip 718. Referring to FIGS. 18-21, as the adjustable panel 630 nears the cafeteria configuration, the plunger 794 engages the motion control device 796. The plunger 794 is depressed, hindering motion of the adjustable panel 630, until the plunger 794 reaches the slow-to-home transition 797. The plunger 794 then extends until the plunger 794 reaches the cafeteria detent 795 and the adjustable panel 630 is in the cafeteria configuration. If the user continues to move the adjustable panel 630 in the first longitudinal direction 664, the plunger 794 is depressed, warning the user that the adjustable panel 630 is being overextended. Once the user releases the adjustable panel 630, the adjustable panel 630 returns to the cafeteria configuration. Similarly, should the adjustable panel 630 have excess momentum upon reaching the cafeteria detent 795, this can be dissipated through friction during the additional travel toward, and while returning from, the limit of over-travel 799.

Figure 20:
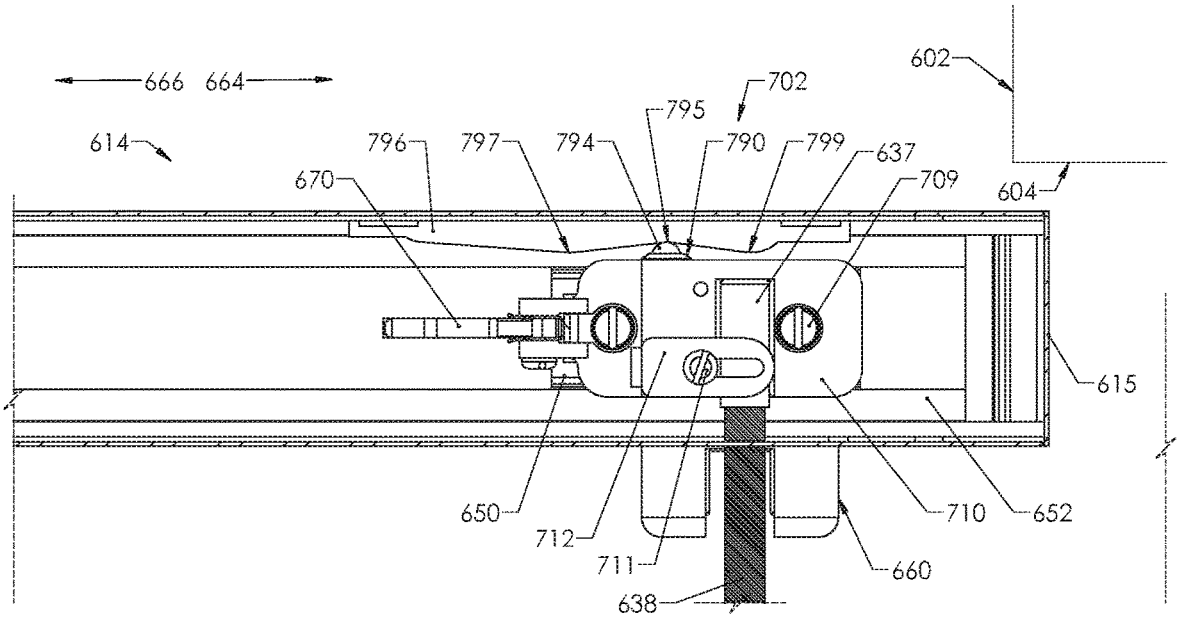
Figure 21:
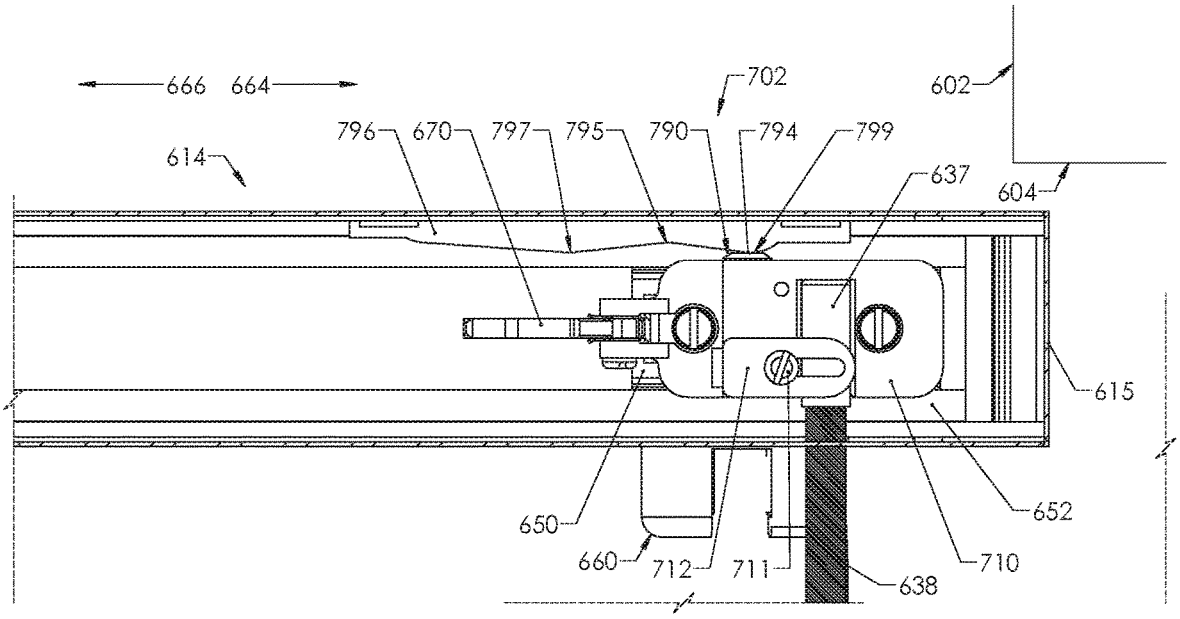
Figure 22:
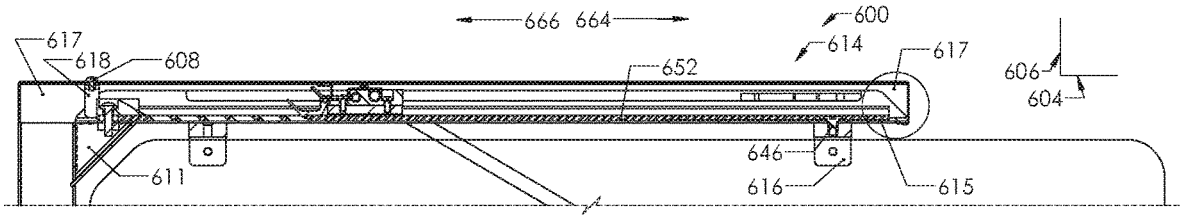
FIG. 22 is a side section view of the guide rail system of FIG. 1.
Figure 23:
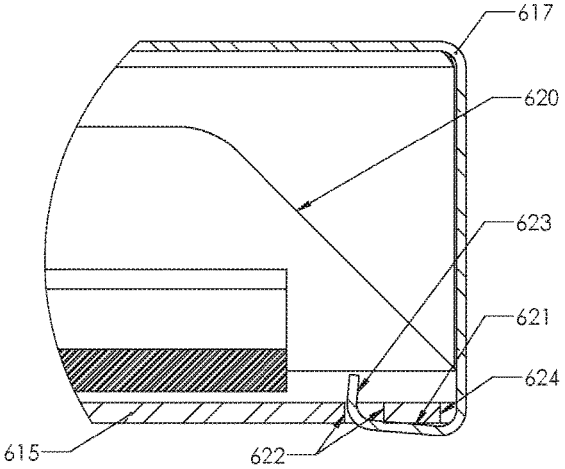
FIG. 23 is a side detail section view of the guide rail system of FIG. 1.
Figure 24:
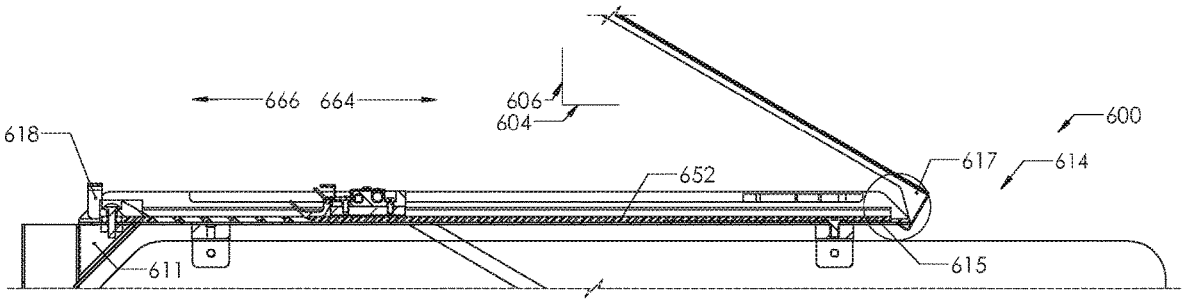
FIG. 24 is a side section view of the guide rail system of FIG. 1.
Figure 25:
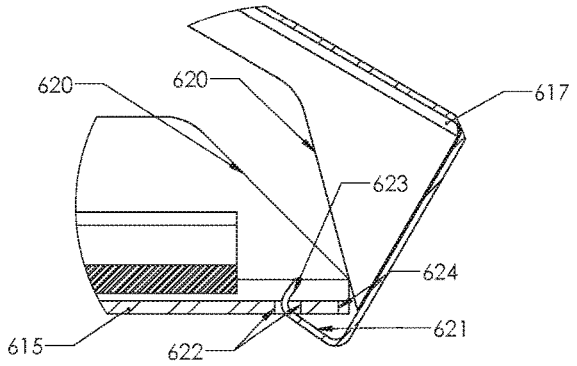
FIG. 25 is a side detail section view of the guide rail system of FIG. 1.

The guide rail systems 614 are configured to adjust the longitudinal positions of the adjustable panel 630 in the cafeteria configuration and the buffet configuration. Referring to FIGS. 7, 10, and 20, when the guide rail bolt 646 and the pawl ramp bolt 657 are loosened, the guide rail mounting slot 647 and the guide rail mounting slot 656 permit adjustment of the longitudinal position of the guide rail 652. When the guide rail 652 is moved, the pawl apertures 678 also move, adjusting the point at which the tooth 680 engages the pawl aperture 678 to hold the adjustable panel 630 in the buffet configuration. Additionally, when the guide rail bolt 646 and the pawl ramp bolt 657 are loosened, the mounting tabs 798 are free to translate longitudinally throughout the pinch provision 648, permitting adjustment of the longitudinal position of the motion control device 796. When the motion control device 796 is moved, the cafeteria detent 795 also moves, adjusting the point at which the plunger assembly 790 engages the cafeteria detent 795 to hold the adjustable panel 630 in the cafeteria configuration. Once the locations of guide rail 652 and the motion control device 796 have been adjusted, the guide rail bolt 646 and the pawl ramp bolt 657 may be tightened to hold them in place.

Referring to FIGS. 22-25, the coupling between the frame rail 615 and the frame rail cover 617 is shown according to an exemplary embodiment. Near the end of the frame rail 615, the frame rail 615 defines an aperture, shown as top rail mounting slot 622. The top rail mounting slot 622 extends vertically through the frame rail 615. The frame rail cover 617 includes a flange, shown as bottom flange 621, which extends below the frame rail 615. A protrusion or projection, shown as mounting key 623, extends upward from the bottom flange 621. To couple the frame rail cover 617 to the frame rail 615, the mounting key 623 is inserted into the top rail mounting slot 622, pivotally coupling the frame rail 615 and the frame rail cover 617. The frame rail cover 617 is then rotated downward onto the frame rail 615. A bottom front portion of the frame rail 615, shown as relief 624, is cut away to facilitate the frame rail cover 617 extending around the frame rail 615. As the frame rail cover 617 is rotated down into position, a pair of corresponding surfaces of the frame rail 615 and the frame rail cover 617, shown as frame rail surfaces 620, engage one another, locating the frame rail cover 617 relative to the frame rail 615. This engagement ensures that the frame rail 615 and the frame rail cover 617 are in constant contact, limiting or preventing relative motion or rattling. The frame rail surfaces 620 are also configured to permit rotation of the frame rail cover 617 into the desired position (e.g., such that the frame rail surfaces 620 do not interfere with one another prematurely).

A mount, shown as frame rail cover mounting bracket 618, is coupled to the frame rail 615 near the spine 720. The frame rail cover mounting bracket 618 extends upward to meet an underside of the frame rail cover 617. The frame rail cover mounting bracket 618 defines a threaded aperture. A fastener, shown as cover screw 608, extends through an aperture defined in the frame rail cover 617 and threadedly engages the threaded aperture of the frame rail cover mounting bracket 618. The cover screw 608, the mounting key 623, and the frame rail surfaces 620 constrain the frame rail cover 617 relative to the frame rail 615. Accordingly, the frame rail cover 617 is coupled to the frame rail 615 using only a single fastener. This facilitates assembly and disassembly for cleaning and maintenance, reduces the potential for buildup of contaminants, and makes the breath guard 600 more visually appealing. The cover screw 608 is positioned near the rear of the breath guard 600 to be farther from the field-of-view of the customer.

Referring to FIGS. 26-31, each bracket 612 is removably coupled to the top surface 61 of the base 12. Although only one bracket 612 is shown, it should be understood that the other bracket 612 may utilize a similar arrangement. A series of protrusions, shown as studs 62, are coupled to the top surface 61. By way of example, the studs 62 may be welded or fastened to the base 12. The studs 62 extend upward from the top surface 61 and are threaded. A bracket, shown as mounting bracket 725, defines a series of apertures configured to receive the studs 62 therethrough. A series of fasteners, shown as stud nuts 63, threadedly engage the studs 62 to couple the mounting bracket 725 to the top surface 61. In other embodiments, the mounting brackets 725 are otherwise coupled to the top surface 61 (e.g., adhered, fastened, welded, etc.). The mounting brackets 725 can be installed individually and without being attached to the brackets 612. The mounting brackets 725 are light and easy to maneuver, facilitating proper spacing and alignment of the mounting brackets 725 without the use of specialized tools or equipment.

Each mounting bracket defines a series of flanges, shown as capture flanges 726, extending upward from the top surface 61. The capture flanges 726 face forward and define a recess or slot 733 having an inclined top surface. A series of laterally extending pins or rods, shown as capture pins 727, are coupled to the brackets 612. The capture pins 727 extend laterally between two walls of the bracket 612. In one embodiment, shown in FIG. 28, pairs of capture pins 727 are laterally aligned with one another and each extend partway between the walls of the bracket 612 such that a gap is formed between the capture pins 727. In another embodiment, shown in FIG. 29, each capture pin 727 extends fully across the space between the walls of the bracket 612, engaging each wall. The capture pins 727 are configured to be received within the slots 733 to couple the breath guard 600 to the top surface 61.

A first fastener, shown as jack screw nut 722, is fixedly coupled to the spine 720. The jack screw nut 722 defines a threaded aperture. A second fastener, shown as jack screw 723, extends longitudinally through the threaded aperture and threadedly engages the jack screw nut 722. Accordingly, when tightened or loosened, the jack screw 723 moves longitudinally relative to the bracket 612. The head of the jack screw 723 is positioned within the spine 720 such that the jack screw 723 is not visible. The jack screw 723 and the jack screw nut 722 may be preinstalled at a factory such that the user needs only to tighten the jack screw 723 when installing the breath guard 600. The jack screw 723 can be tightened or loosened by inserting a tool (e.g., an Allen key or an Allen socket) through a small aperture in the spine 720 to engage the jack screw 723. This small aperture may be plugged after installation. The mounting bracket 725 further includes a flange or protrusion, shown as jacking tab 724. The jacking tab 724 extends substantially vertically and is positioned near the rear end of the mounting bracket 725.

Figure 26:
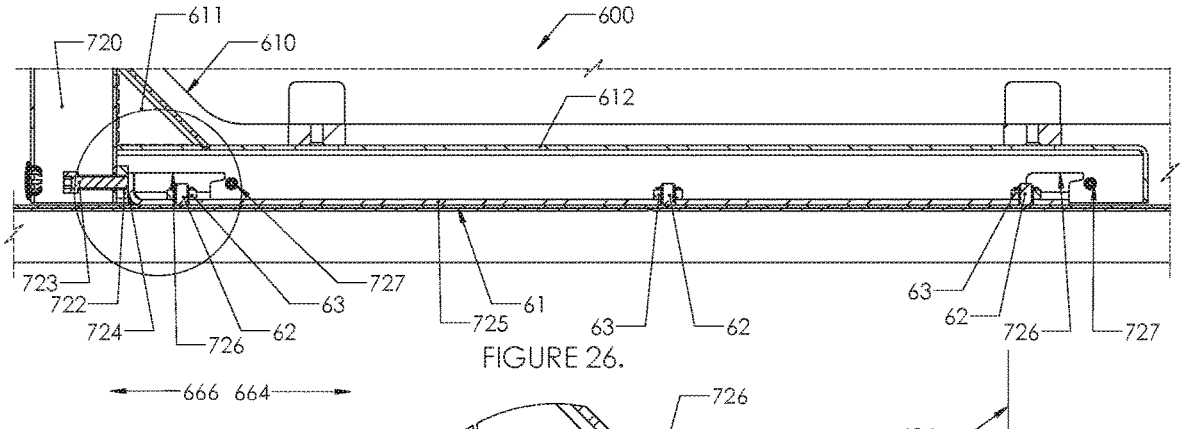
FIG. 26 is a side section view of a bracket and a mounting bracket of the breath guard of FIG. 1.
Figure 27:
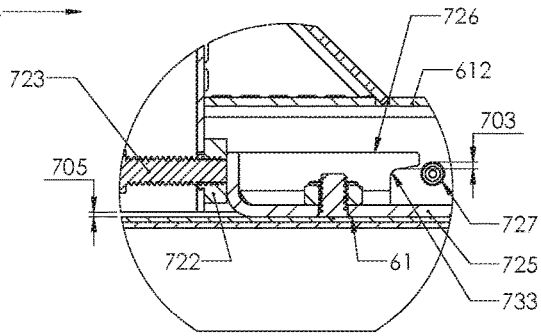
FIG. 27 is a side detail section view of the bracket and the mounting bracket of FIG. 26.
Figure 28:
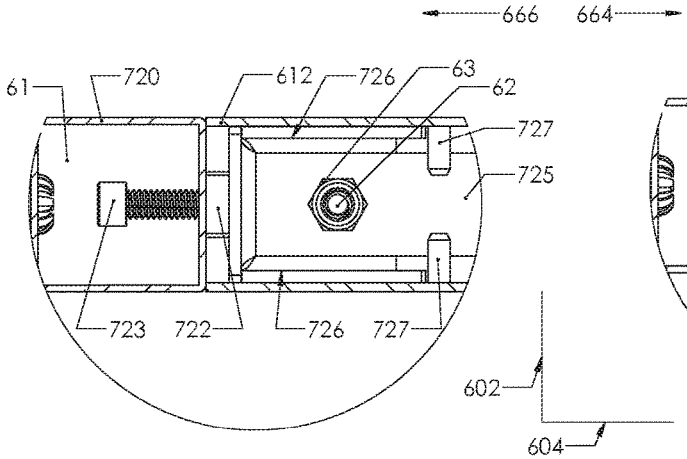
FIG. 28 is a top detail section view of the bracket of FIG. 26.
Figure 29:
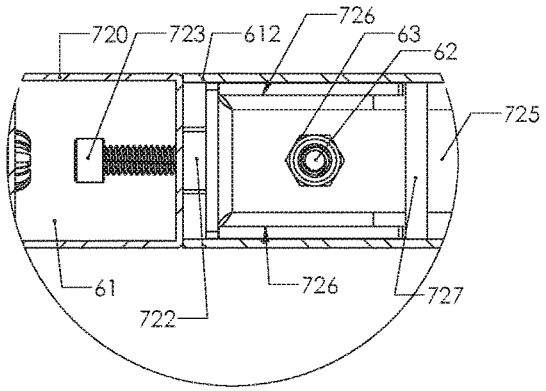
FIG. 29 is a top detail section view of a bracket for a breath guard, according to an exemplary embodiment.

The use of the mounting brackets 725 and the jack screws 723 simplifies the installation process of the breath guard 600. To couple the breath guard 600 to the top surface 61, the breath guard 600 is set onto the top surface 61 as shown in FIGS. 26 and 27 such that the brackets 612 receive the mounting brackets 725 and the capture pins 727 are positioned directly in front of the slots 733. As shown in FIG. 27, a vertical distance 703 between the top of the capture pin 727 and the top surface of the slot 733 is greater than or equal to a vertical distance 705 between the bracket 612 and the top surface 61. Accordingly, when the capture pins 727 are fully seated within the slots 733, the bracket 612 will be pressed against the top surface 61.

Figure 30:
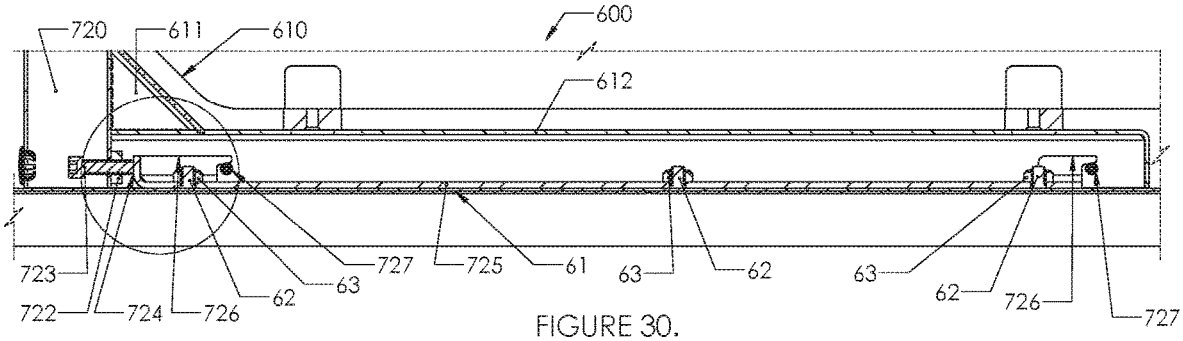
FIG. 30 is a side section view of the bracket and the mounting bracket of FIG. 26.
Figure 31:
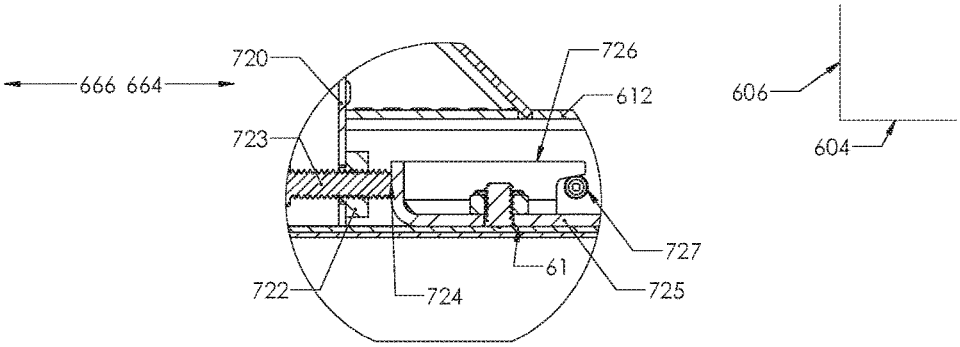
FIG. 31 is a side detail section view of the bracket and mounting bracket of FIG. 26.
Figure 32:
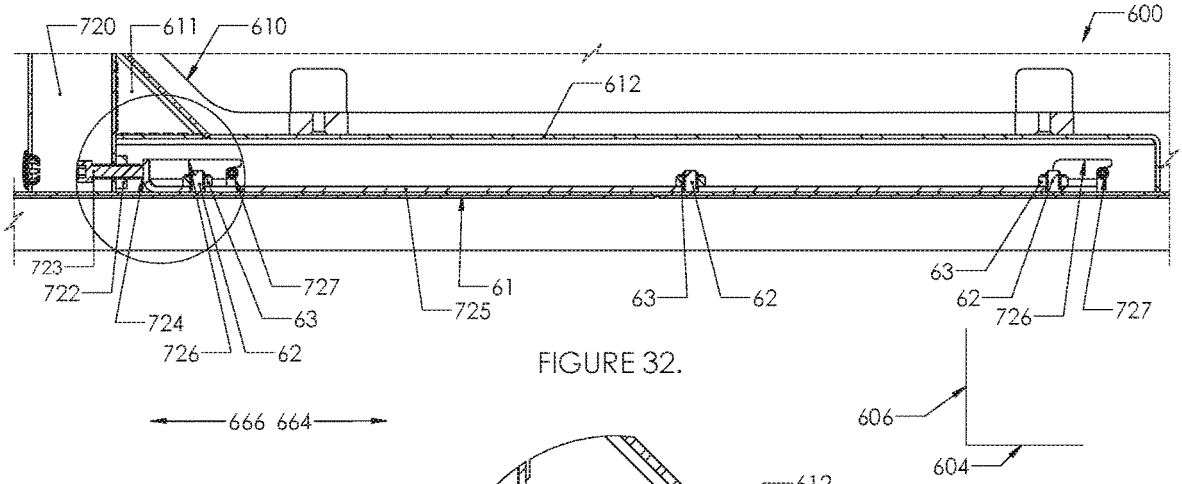
FIG. 32 is another side section view of the bracket and the mounting bracket of FIG. 26.
Figure 33:
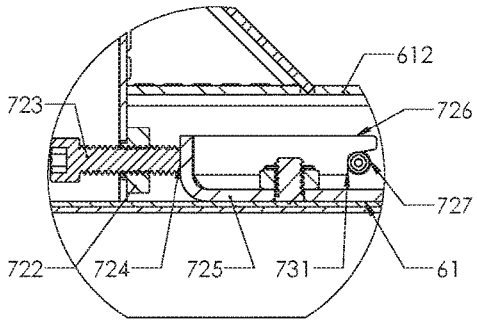
FIG. 33 is another side detail section view of the bracket and mounting bracket of FIG. 26.
Figure 34:
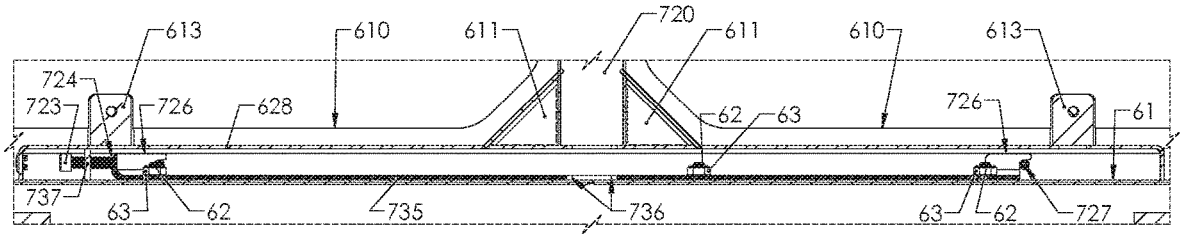
FIG. 34 is a side section view of a bracket and a mounting bracket for a breath guard, according to an exemplary embodiment.

The jack screw 723 is tightened, moving the jack screw 723 toward the jacking tab 724. The jack screw 723 engages the jacking tab 724, moving the breath guard 600 backward relative to the base 12. The capture pins 727 engage the capture flanges 726 and are driven into the slots 733. The inclined surfaces of the capture flanges 726 force the capture pins 727 and the bracket 612 downward toward the top surface 61, as shown in FIGS. 30 and 31. The torque required to tighten the jack screw 723 depends on the slopes of the surfaces of the capture flanges 726. Eventually, as shown in FIGS. 32 and 33, the capture pins 727 engage vertical or near vertical surfaces of the capture flanges 726, shown as capture flange stops 731, locking the brackets 612 to the mounting brackets 725 and the top surface 61. This is signaled to the user by a large increase in the torque necessary to tighten the jack screw 723. This increase in torque can be detected by any user, regardless of skill. To remove the breath guard 600, the jack screws 723 can be loosened, and the breath guard 600 can be moved forward, moving the capture pins 727 out of the slots 733.

Figure 35:
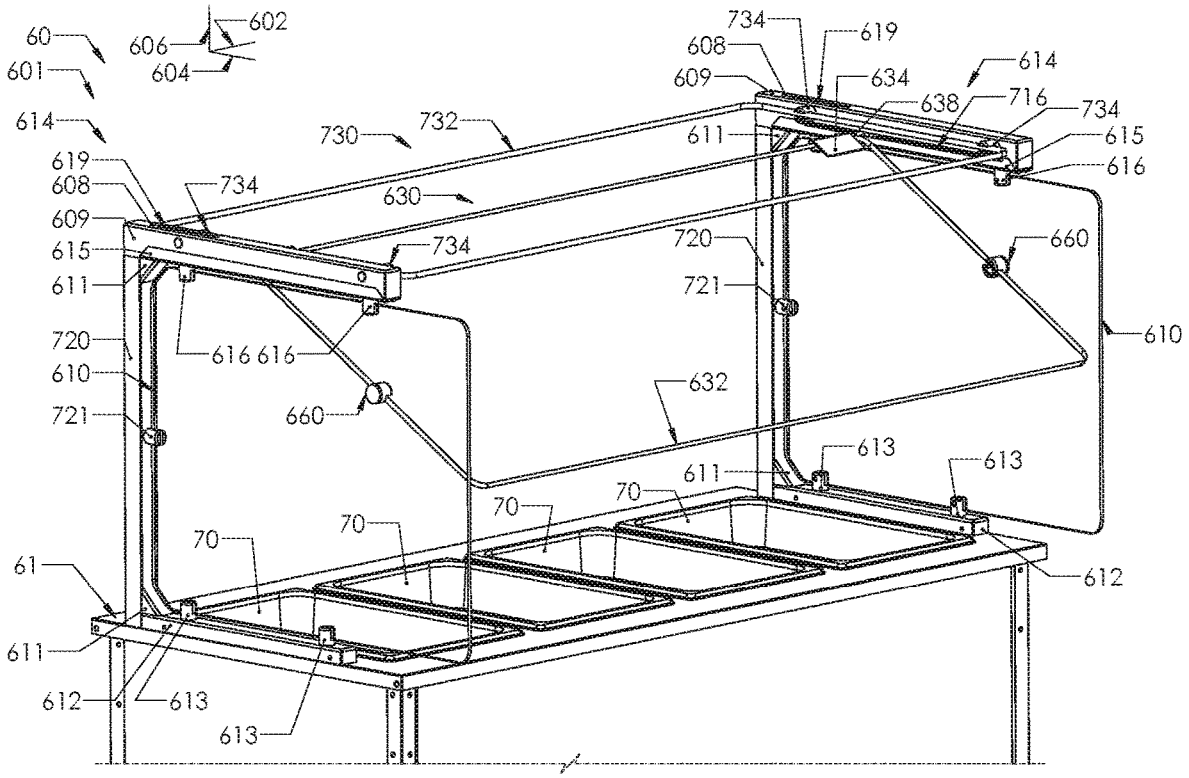
FIG. 35 is a perspective view of a food display system including a breath guard, according to another exemplary embodiment.

Referring to FIG. 35, a breath guard 601 is shown as an alternative embodiment to the breath guard 600 with the adjustable panel 630 in the buffet configuration. The breath guard 601 may be substantially similar to the breath guard 600, except the breath guard 601 includes a shelf system 730 that extends along a top surface of the breath guard 601. The shelf system 730 includes a panel, shown as shelf panel 732. The shelf panel 732 may be made from a material that is substantially similar to that of the side panels 610. The shelf panel 732 prevents debris from reaching the food pans 70 from above the breath guard 601 and increases the strength of the breath guard 601. The shelf panel 732 may additionally provide storage. In the breath guard 601, the frame rail covers 617 of the breath guard 600 are replaced with frame rail covers 609. The frame rail covers 609 are substantially similar to the frame rail covers 617 except the frame rail covers 609 are coupled to a pair of couplers, clamps, brackets, or clips, shown as panel clips 734. The panel clips 734 are substantially similar to the panel clips 613. The panel clips 734 extend laterally inward to receive the shelf panel 732, coupling the shelf panel 732 to the frame rail covers 609. Alternatively, the panel clips 734 may be coupled to top surfaces of the frame rail covers 609 and extend upward to meet the shelf panel 732. The shelf panel 732 may be coupled to the panel clips 734 by fasteners, adhesive, being received within a slot, or through some other mechanism. The panel clips 734 may selectively fixedly couple the shelf panel 732 to the frame rail covers 609 (e.g., with a set screw) such that, when attached, the shelf panel 732 does not move relative to the side frame assemblies 607 and transfers loads between the side frame assemblies 607. Alternatively, the shelf panel 732 may be slidably coupled to the panel clips 734 such that the shelf panel 732 can be easily slid out of the panel clips 734 to facilitate cleaning.

Figure 36:
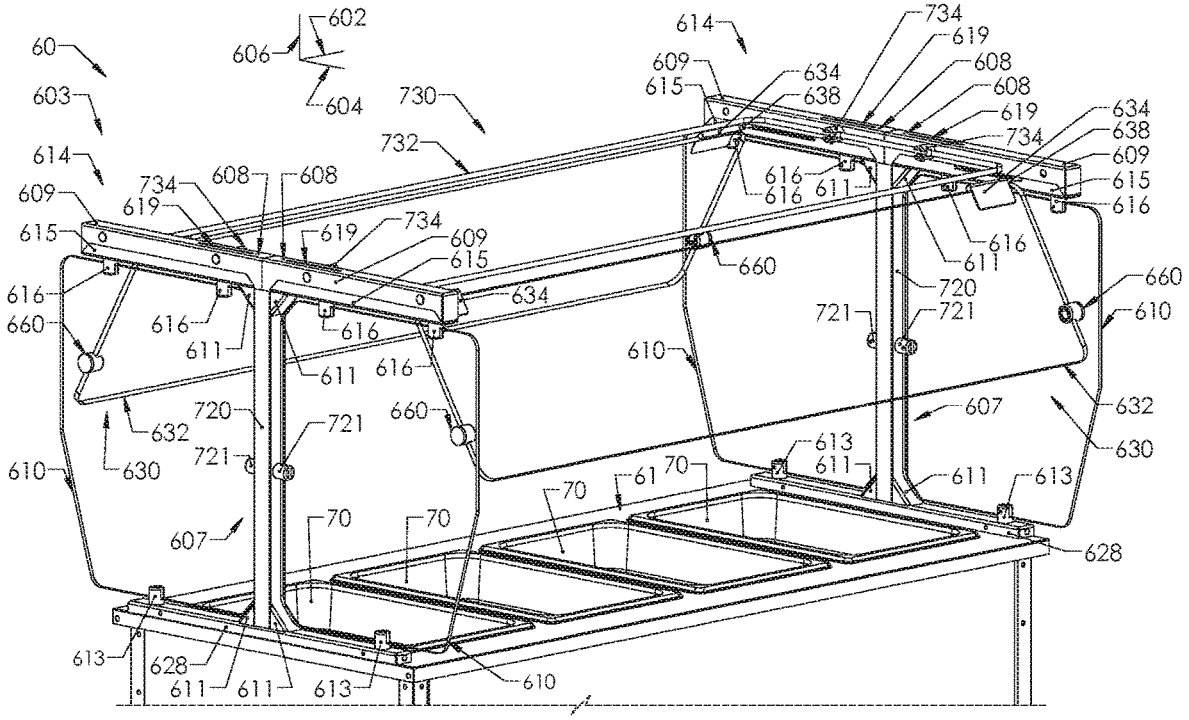
FIG. 36 is a perspective view of a food display system including the breath guard of FIG. 34.

Referring to FIG. 36, a double-sided breath guard, shown as breath guard 603, is an alternative embodiment to the breath guard 601 and includes a pair of adjustable panels 630 each in the buffet configuration. The breath guard 603 may be substantially similar to the breath guard 600 except as described herein. The breath guard 603 includes a pair of adjustable panels 630, each disposed on an opposite longitudinal side of the system 60. This configuration may be useful in buffet scenarios where customers access the food pans 70 from both longitudinal sides (i.e., the front side and the back side) of the system 60. Accordingly, in some such embodiments, the breath guard 603 may be configured such that the adjustable panels 630 are only reconfigurable into a buffet configuration and not into a cafeteria configuration. However, such embodiments still facilitate adjustment of the orientation of the adjustable panels 630. The length of the adjustable panel 630 (e.g., outward from the axis of rotation 642) and the locations of the wrist systems 660 may be varied while still providing an effective buffet configuration.

Each side frame assembly 607 includes two guide rail systems 614, each facing opposite directions. Both of the guide rail systems 614 are supported by a single spine 720. The spine 720 is supported by a support or foot, shown as double-sided bracket 628. The double-sided bracket 628 extends both forward and rearward from the spine 720 along the longitudinal axis 604. The guide rail systems 614 and the adjustable panels 630 may be shorter relative to embodiments that are reconfigurable into a cafeteria configuration. The guide rail systems 614 include frame rail covers 609, all of which cooperate to support a shelf panel 732. In some embodiments, the inclusion of the shelf panel 732 facilitates the breath guard 603 conforming with one or more regulations (e.g., NSF requirements).

The double-sided bracket 628 may be coupled to the top surface 61 using a mounting bracket 735. The mounting bracket 735 may be substantially similar to the mounting bracket 725 except as disclosed herein. Instead of the jack screw 723 entering through the spine 720, the jack screw 723 is accessed (e.g., inserted, tightened) through an aperture defined in the end of the double-sided bracket 628. A plate, shown as threaded insert 737, is coupled to the double-sided bracket 628 and defines a threaded aperture. The jack screw 723 extends through the threaded aperture, threadedly engaging the threaded insert 737. An aperture, shown as wiring passage 736, extends through the mounting plate 735. The wiring passage 736 permits wires (e.g., for heating lamps, for lights, etc.) to pass through the mounting plate 735 and into the spine 720.

Figure 37:
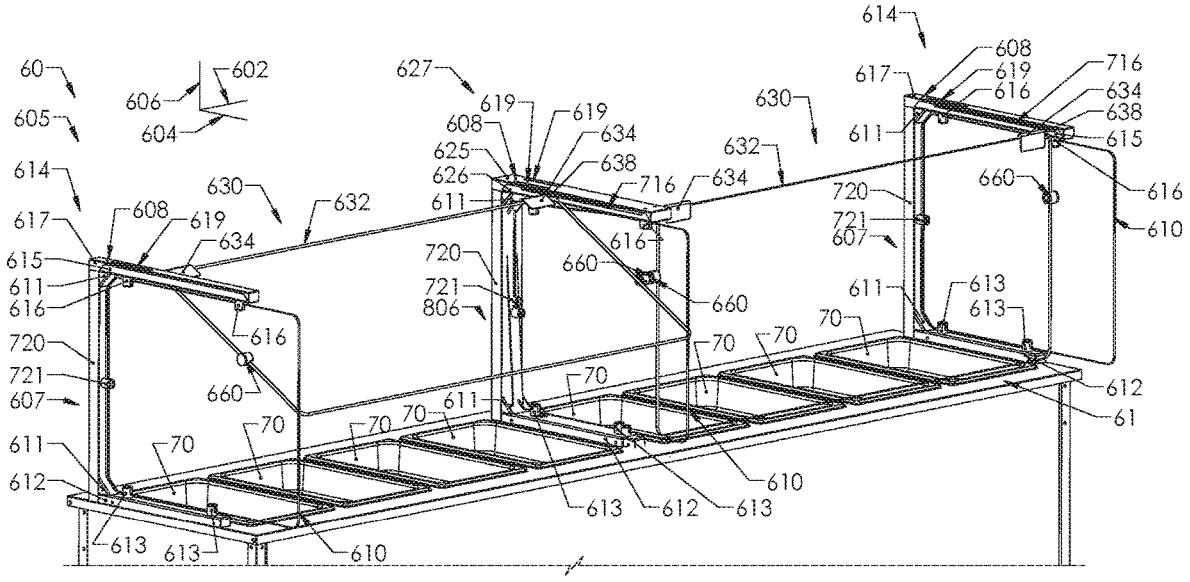
FIG. 37 is a perspective view of a food display system including a breath guard, according to another exemplary embodiment.

Referring to FIG. 37, a side-by-side breath guard system, shown as breath guard 605, is an alternative embodiment to the breath guard 600. The breath guard 605 may be substantially similar to the breath guard 600 except as described herein. The breath guard 605 includes two adjustable panels 630 positioned adjacent one another. One adjustable panel 630 is shown in the buffet configuration, and the other adjustable panel 630 is shown in the cafeteria configuration. The breath guard 605 may be used in a setting where many different food products are to be displayed simultaneously.

The breath guard 605 may serve a similar purpose to two breath guards 600 placed adjacent one another. However, instead of having two of the side frame assemblies 607 positioned directly adjacent one another, a center frame assembly 806 supports two of the adjustable panels 630, reducing the number of components. The center frame assembly 806 includes a bracket 612 and a spine 720, similar to the side frame assemblies 607. However, the guide rail system 614 is replaced with a side-by-side guide rail system 627 that includes a frame rail 626 and a frame rail cover 625. The side-by-side guide rail system 627 includes two of the adjustment mechanisms 668, each of which operates independently and is coupled to a different one of the adjustable panels 630. To facilitate connections between the adjustment mechanisms 668 and the respective adjustable panels 630, the frame rail 626 and the frame rail cover 625 cooperate to define two pin slots 716, each facing opposite directions. Additionally, two of the wrist systems 660 are coupled to the adjustment mechanism 668 through a side panel 610. The wrist systems 660 face in opposite directions and each receive one of the adjustable panels 630.

In other embodiments, the breath guard 605 is modified to include a pair of shelf panels 732, each of which are positioned above one of the adjustable panels 630. The shelf panels 732 may be coupled to the side frame assemblies 607 and the center frame assembly 806 as described with respect to FIG. 35. Additionally or alternatively, the breath guard 605 may be configured as a double-sided breath guard having two adjustable panels 630 on each longitudinal side of the system 60, similar to the breath guard 603 shown in FIG. 36.

The system 60 may be made with various materials having properties suitable for the applications described herein. The system 60 may be made with food safe materials that are noncorrosive and nontoxic. The side panels 610, shelf panel 732, and the panel 632 may be made with glass or another type of transparent material to facilitate a clear view of the food in the food pans 70 from outside of the breath guard 600. Alternatively, the side panels 610, the shelf panel 732, and the panel 632 may be opaque, translucent, or otherwise alter visibility therethrough (e.g., with a tint, with a mirror coating, etc.). In some embodiments, the side panels 610, the shelf panel 732, and/or the panel 632 are selectively reconfigurable between different levels of visibility (e.g., with a switchable color or darkness filter). The various structural members (e.g., the frame rail 615, the spine 720, the 612, etc.) may be made from stainless steel, aluminum, composites, or another type of material that offers sufficient strength for the structure of the breath guard 600 without the potential for corrosion.

The breath guards disclosed herein may be used as display cases for products other than food. By way of example, the display cases may be used to display jewelry, trading cards, electronics, firearms, tools, or other valuable items. The display cases would protect the products from being accessed by customers positioned in front of the display cases while still facilitating viewing of the products through the display cases. The display cases would facilitate access to the products by a shopkeeper or other operator positioned behind the display cases. The display cases may be selectively reconfigurable to selectively permit or prevent access by a customer to one or more products therein (e.g., by raising or lowering the adjustable panel 630). The various regulations and requirements described herein with respect to breath guards may not apply to the display cases.

The construction and arrangement of the apparatus, systems, and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, some elements shown as constructed from multiple parts or elements may be integrally formed, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

References herein to the positions of elements (e.g., "top," "bottom," "above," "below," "upper," "lower," etc.) are merely used to describe the orientation of various elements as illustrated in the Figures. It should be noted that the orientation of various elements may differ according to other exemplary embodiments, and that such variations are intended to be encompassed by the present disclosure.

What is claimed is:

1. A breath guard for a food serving system, comprising:

a first support and a second support positioned laterally offset from one another;

a guide rail coupled to the first support and extending in a substantially longitudinal direction;

an adjustable panel extending between the first support and the second support, wherein the adjustable panel is rotatably and translatably coupled to the guide rail; and an adjustment mechanism coupled to the adjustable panel and configured to selectively engage the guide rail in a plurality of locations;

wherein the adjustable panel is rotatable relative to the guide rail about an axis of rotation that extends laterally; and wherein the adjustment mechanism is configured to prevent longitudinal movement of the adjustable panel relative to the guide rail in a first direction and allow longitudinal movement of the adjustable panel in a second direction opposite the first direction when the adjustment mechanism engages the guide rail, such that the adjustable panel is selectively repositionable between a plurality of longitudinal positions relative to the guide rail.

2. The breath guard of claim 1, wherein the adjustment mechanism is configured to selectively engage the guide rail in a finite number of locations, and wherein the adjustable panel is selectively repositionable between a finite number of longitudinal positions relative to the guide rail.

3. The breath guard of claim 1, wherein the guide rail includes a plurality of pawl apertures, wherein the adjustment mechanism includes a rotatable pawl configured to selectively engage the pawl apertures, and wherein the pawl and the pawl apertures are configured to prevent longitudinal movement of the adjustable panel relative to the guide rail in the first direction when the pawl selectively engages the pawl apertures of the guide rail.

4. The breath guard of claim 3, wherein the pawl and the pawl apertures are correspondingly shaped to prevent longitudinal movement of the adjustable panel in the first direction when the pawl engages the pawl apertures, and wherein the pawl and the pawl apertures are correspondingly shaped to allow longitudinal movement of the adjustable panel in the second direction opposite the first direction.

5. The breath guard of claim 4, wherein the pawl includes a tooth configured to selectively engage the pawl apertures and the tooth is biased by gravity toward the guide rail.

6. The breath guard of claim 5, wherein the adjustment mechanism further includes a carriage including a clip;

wherein the pawl further includes a catch tab; and wherein the pawl is rotatable so that in a deactivated position the catch tab is secured by the clip and the tooth is not engaged with a pawl aperture to allow the adjustment mechanism to translate relative to the guide rail.

7. The breath guard of claim 6, wherein the carriage further includes a plunger biased to an extended position by a spring;

wherein the guide rail further includes a motion control device including a detent; and wherein the plunger is in the extended position when aligned with the detent to maintain the adjustable panel in an NSF cafeteria position.

8. The breath guard of claim 7, wherein the adjustable panel is selectively reconfigurable between a plurality of positions, the plurality of positions including an NSF cafeteria position and an NSF buffet position.

9. The breath guard of claim 7, wherein the motion control device further includes a first sloped surface located on a first side of the detent and a second sloped surface on a second side of the detent.

10. The breath guard of claim 9, further comprising:

a wrist system including a mounting plate and a wrist body rotatably coupled to the mounting plate, wherein the wrist body includes a slot that receives the adjustable panel and is configured to allow the adjustable panel to slide within the slot.

11. The breath guard of claim 5, wherein the adjustment mechanism further includes a carriage including a plunger biased to an extended position by a spring;

wherein the guide rail further includes a motion control device including a detent; and wherein the plunger is in the extended position when aligned with the detent to maintain the adjustable panel in an NSF cafeteria position.

12. The breath guard of claim 11, wherein the adjustable panel is selectively reconfigurable between a plurality of positions, the plurality of positions including an NSF cafeteria position and an NSF buffet position.

13. The breath guard of claim 12, wherein the motion control device further includes a first sloped surface located on a first side of the detent and a second sloped surface on a second side of the detent.

14. The breath guard of claim 11, further comprising:

a wrist system including a mounting plate and a wrist body rotatably coupled to the mounting plate, wherein the wrist body includes a slot that receives the adjustable panel and is configured to allow the adjustable panel to slide within the slot.

15. The breath guard of claim 1, wherein the adjustable panel is selectively reconfigurable between a plurality of positions, the plurality of positions including an NSF cafeteria position and an NSF buffet position.

16. The breath guard of claim 1, further comprising:

a wrist system including a mounting plate and a wrist body rotatably coupled to the mounting plate, wherein the wrist body includes a slot that receives the adjustable panel and is configured to allow the adjustable panel to slide within the slot.

17. A breath guard for a food serving system, comprising:

a first support and a second support positioned laterally offset from one another;

a first guide rail coupled to the first support and extending in a substantially longitudinal direction;

a second guide rail coupled to the second support and extending substantially parallel to the first guide rail;

an adjustable panel extending between the first support and the second support, wherein the adjustable panel is rotatably and translatably coupled to the first guide rail and the second guide rail;

an adjustment mechanism coupled to the adjustable panel and configured to selectively engage the first guide rail; and a first wrist system including a first mounting plate and a first wrist body rotatably coupled to the first mounting plate, wherein the first mounting plate is coupled to the first support, and wherein the first wrist body includes a first slot that receives the adjustable panel and is configured to allow the adjustable panel to slide within the first slot;

a second wrist system including a second mounting plate and a second wrist body rotatably coupled to the second mounting plate, wherein the second mounting plate is coupled to the second support, and wherein the second wrist body includes a second slot that receives the adjustable panel and is configured to allow the adjustable panel to slide within the second slot;

wherein the adjustable panel is rotatable relative to the first guide rail and the second guide rail about an axis of rotation that extends laterally; and wherein the adjustment mechanism is configured to prevent longitudinal movement of the adjustable panel relative to the first guide rail in a first direction and allow longitudinal movement of the adjustable panel in a second direction opposite the first direction when the adjustment mechanism engages the first guide rail.

18. The breath guard of claim 17, wherein the adjustment mechanism is configured to selectively engage the first guide rail in a finite number of locations, and wherein the adjustable panel is selectively repositionable between a finite number of longitudinal positions relative to the first guide rail.

19. The breath guard of claim 17, wherein the first guide rail includes a plurality of pawl apertures, wherein the adjustment mechanism includes a rotatable pawl configured to selectively engage the pawl apertures, and wherein the pawl and the pawl apertures are configured to prevent longitudinal movement of the adjustable panel relative to the first guide rail in the first direction when the pawl selectively engages the pawl apertures of the guide rail.

20. The breath guard of claim 19, wherein the pawl and the pawl apertures are correspondingly shaped to prevent longitudinal movement of the adjustable panel in the first direction when the pawl engages the pawl apertures, and wherein the pawl and the pawl apertures are correspondingly shaped to allow longitudinal movement of the adjustable panel in the second direction opposite the first direction.

* * * * *